US007789256B2

(12) United States Patent
Petzitillo, Jr. et al.

(10) Patent No.: US 7,789,256 B2
(45) Date of Patent: Sep. 7, 2010

(54) MULTIPURPOSE BULK CONTAINER

(75) Inventors: Anthony D. Petzitillo, Jr., Sicklerville, NJ (US); Todd A. Fowler, Sewell, NJ (US)

(73) Assignee: Wastequip, Inc., Cleveland, OH (US)

( * ) Notice: Subject to any disclaimer, the term of this patent is extended or adjusted under 35 U.S.C. 154(b) by 839 days.

(21) Appl. No.: 11/566,760

(22) Filed: Dec. 5, 2006

(65) Prior Publication Data

US 2007/0151971 A1 Jul. 5, 2007

Related U.S. Application Data

(60) Provisional application No. 60/742,513, filed on Dec. 5, 2005.

(51) Int. Cl.
*B65D 88/00* (2006.01)

(52) U.S. Cl. ..... 220/1.5; 220/4.26; 220/378; 220/810; 220/826; 220/849; 220/908; 232/43.4; 206/501

(58) Field of Classification Search ..... 220/1.5, 220/378, 849, 4.26, 810, 826, 908; 206/501; 232/43.4

See application file for complete search history.

(56) References Cited

U.S. PATENT DOCUMENTS 3,735,713 A * 5/1973 Glassmeyer ..... 108/53.5
5,890,595 A * 4/1999 Credle, Jr. ..... 206/501
6,364,153 B1 4/2002 Petzitillo, Jr. et al.
6,592,155 B1 * 7/2003 Lemley et al. ..... 292/7
7,296,704 B2 * 11/2007 Ferrini ..... 220/1.5
2004/0169038 A1 * 9/2004 Pickler ..... 220/1.5

* cited by examiner

*Primary Examiner*—Anthony Stashick
*Assistant Examiner*—Elizabeth Volz
(74) *Attorney, Agent, or Firm*—Duane Morris LLP

(57) ABSTRACT

A container has door openings at opposite ends for dedicated loading from the discharge of a waste compactor at a door on a vertical hinge axis and unloading by tilt dumping through a swinging panel on a horizontal axis. A removable lid encompasses a substantial portion of the top. The container has standard intermodal fittings. The container can be loaded while on a compaction-reinforcement chassis with a structure that bears against the dumping side door to resist compactor forces. The container is reinforced notwithstanding the plural doors, including at a header and sill at the loading end, a rigid upper frame at traversing between the sides at the hinge for the dumping end, and by a container base including transverse fork-truck tine receptacles. The container is not limited to the specialized reception of compactor slugs and is also useful as a general purpose bulk container.

18 Claims, 22 Drawing Sheets

MULTIPURPOSE BULK CONTAINER

CROSS-REFERENCE TO RELATED APPLICATION

This application claims the benefit of U.S. provisional patent application No. 60/742,513, filed Dec. 5, 2005.

FIELD OF THE INVENTION

The invention relates to a multiple-door design for intermodal containers, especially for transporting bulk material such as compacted municipal waste. The container is structured to permit loading and unloading in different contexts via different openings, while remaining structurally sound.

BACKGROUND OF THE INVENTION

Intermodal containers can be used in general to hold and ship various materials, including bulk materials, and can be useful as transport containers for waste material. A primary advantage of intermodal containers is the use of connector fittings at standard spacings, typically at each of the eight corners of a rectangular container or box in one of several standard sizes. The connector fittings enable the intermodal container to be affixed to mountings placed at the same standard spacings on movable chassis configurations appropriate for road, rail, sea or other transport, for stacking and the like. Likewise, the containers can be manipulated using lifts and spreader frames having grappling devices at the standard spacings.

Advantageously, solid waste is compacted into a container of one form or another. Intermodal containers can be used to hold and ship bulk materials, and might be used to accumulate compacted material from a compactor. However, refuse containers for waste material, compactor containers and the like, need to be structured for rough treatment, whereas shipping containers are advantageously of limited weight. Also, shipping containers advantageously have one or more access doors, and access doors generally weaken a container structure in a manner that presents challenges for use with solid waste in general and compactor products in particular.

Intermodal containers are used in various standard sizes. A typical standard container is a substantially rectilinear box and may measure twenty or forty feet in length, from four to twelve feet high and eight feet to eight feet six inches laterally. The typical container is made using steel plate, optionally with channel-like corrugations, and may comprise reinforcing and framing parts comprising rectangular tubing, angle iron and bar stock.

One of the walls, normally the rear end wall of the typical container, is at least partly occupied by one or more door panels. In semi-trailer shipping container applications, two panels are pivotally mounted on vertical hinge axes journaled at the corners of the end wall. The panels lap one another at the midline of the container in the rear. For waste containers and other applications that advantageously have a heavier door or a sealing door closure, one panel may be preferred instead of two. The panel typically is hinged on a vertical axis and arranged to bear against a compressible seal. On the latch side (opposite from the hinge), a strike support can support the door panel in alignment. Clamping devices and be used to draw the door panel so as to compress and seal with a gasket disposed in a frame provided around the end wall opening, mounted either to the door panel or to the frame.

For solid waste handling and other demanding applications, the door panel, like the container as a whole, should be structured for rough handling, i.e., heavy duty and thus likely to be heavy in weight. Mounting a full-width single door panel on a hinge axis cantilevers the weight of the door panel on the rear of the container sidewall carrying the hinge, requiring structural support. Opening, closing and sealing the door, which preferably should be possible by manual operations of a single operator likewise is to be considered. The structural and operational requirements, versus the need for precision if sealing is also intended, reasonably total weight and the like, are challenging and sometimes inconsistent design objectives.

Access openings such as end door panels might be carried on a hinge mechanism defining a pivot axis along the frame at the side, top or bottom of the associated end wall. For human-operated doors, a vertical hinge axis has the advantage that it is unnecessary to apply force except to overcome inertia. For a dumping container, a horizontal hinge axis at the top of the panel advantageously can be used to permit the door panel to swing open when the container is tipped to unload the contained material by gravity. A sealing door panel preferably has a single integral panel as large as the opening, thus minimizing the complexity of sealing. Two panels hinged on opposite sides of the opening are possible, as are two or more panels with an intermediate accordion fold hinge. Various mechanisms can releaseably hold the door panel(s) in a closed position, typically involving a latching connection between the door panel and the frame of the doorway, at one or more points remote from the hinge axis. There are various choices that can be made, but adapting a door for one of the foregoing structures to take advantage of a given attribute normally makes the door less than optimal with respect to the other attributes.

Container structures vary depending on the cargo and expectations for loading and unloading. Shipping containers thus often are structurally different from waste containers. This it true even though both types are advantageously structured for intermodal shipping (i.e., in standard sizes with receptacle fittings at predetermined standard locations). Containers may also be arranged for roll-on/roll-off loading, tip-dumping using a forklift or tined overhead dumping collection truck, etc.

An exemplary container with intermodal standardized fittings is known from U.S. Pat. No. 6,364,153—Petzitillo. This container has a gasket sealed top cover that can be raised and rolled to tip open toward either side, and an end opening with clamps to facilitate a seal between a hinged end wall and a gasket mounted around the perimeter of the sealed end opening. The gasket material might be carried by the door panel or by the container frame, but in either case, the mounting mechanism for the door panel needs to be configured so as to press the door panel against the frame and thereby to compress the seal or gasket.

By providing a top opening and an end opening, the container in U.S. Pat. No. 6,364,153 permits access from the roll-aside top panel opening or the hinged end opening. The trade-off for having such openings is that the container must otherwise be structurally self supporting. The top panel opening in the '153 patent does not extend to near the top ends, providing some support in the form of stationary structures on the top wall at the ends. Also, the entire container is soundly reinforced with additional support framing and struts. It would be advantageous to include a set of plural door panels on a container in a manner that provides strength as well as access and contributes only modestly to the additional weight of the container as compared to a similarly sized container with fewer doors.

Although various containers exist for accepting, carrying and dumping contained materials in various arrangements, it would be advantageous to provide a multipurpose container that could be used universally for a number of different operations, and with a variety of different types of loading, unloading and access equipment. Such a container could accept loading materials from a variety of sources, such as bulk or waste materials from either of an end-loading compactor connection or a top loading dumper, having optimally placed doors or portals for each alternative, but being structured for adequately rigid and durable support of its shape and limited total weight.

An advantageous such container would be configured to facilitate unloading of contained materials in similarly versatile ways, including a dedicated dumping door. Preferably the dumping arrangement could unload the material loaded as described above, for example a compacted slug of solid waste, simply by tipping the container using, for example, a tipping chassis or a roll-off chassis transporting vehicle.

One advantage of such a container is that it could eliminate the need for the user to stock numerous specialized containers (e.g., separate containers each optimized for particular loading and/or unloading equipment or scenarios, thus reducing the overall cost of purchasing and maintaining an associated large inventory of such specialized containers.

SUMMARY OF THE INVENTION

The invention overcomes a number of practical and operational problems associated with the structure and use of containers, particularly bulk material containers and more particularly solid waste transfer containers adapted to accept dumped material from the top, and/or compactor product or manually loaded material from an end. The same container can be unloaded from the same access points but also can be readily dumped for emptying. The container is structured as described herein to provide adequate structure to support plural displaceable doors or portals, while remaining of a reasonable total weight.

For these and similar objects, a container as disclosed herein includes a container body defining at least spaced side walls and a bottom, and having frame elements at least partly forming first and second door openings disposed at both opposite ends of the container body. The first door opening preferably has a laterally opposite hinge side and latch side. The second door opening can have a vertically opposite top hinge side and a bottom latch side. The container may further have a first container closure including a door panel sized to fit the first door opening, the first door panel hinged to the frame elements at the first hinge side and being movable to occupy or to be moved substantially clear of the first door opening. The second container closure likewise may include a door panel sized to fit the second door opening, the second door panel being hinged to the frame elements at the top hinge side and movable to occupy or swing partly free of the second door opening.

A first compressible sealing gasket may be disposed between the first door panel and the frame elements, and a second compressible sealing gasket may be disposed between the second door panel and the frame elements. The first and second gaskets may be compressed between the respective first and second door panels and frame elements under an operative sealing pressure when the container closures are sealed with the door panels occupying a closing position in the respective first and second door openings.

In the preferred configuration, the container conforms to an intermodal standard size and layout of connectors, for example including twist-lock connectors at each corner. The container thus is arranged to be manipulated, transported and generally handled as a unitary intermodal cargo block using intermodal cargo processing elements at hand and available at seaport, rail, trucking and other facilities.

One or more or all of the door closures is preferably sealable using a gasket arrangement. A first closing mechanism may be provided to hold together the first door panel and the frame elements in conjunction with compression of the first gasket, the first closing mechanism being disposed along at least part of a side edge of the first door opening. A second closing mechanism may be provided to hold together the second door panel and the frame elements in conjunction with compression of the second gasket, the second closing mechanism being disposed along at least part of a bottom edge of the second door opening.

The first door opening may further have a first lip portion disposed along a bottom edge of the first door opening and a second lip portion disposed along a top edge of the first door opening. The first lip portion may be sized to provide a bottom liquid containment volume in a bottom portion of the container body. The first and second lip portions may further form a receiving space between them, receiving the structure at an output end of a waste compaction apparatus so as to allow a slug of compacted material to be pushed into an interior space of the container body via the receiving space.

A reinforcing chassis is also disclosed for use with an intermodal container and is particularly useful for providing reinforcement in conjunction with the multiple doors and especially for loading from a compactor. The chassis may comprise first and second longitudinal support members for supporting a bulk or waste material container thereon.

A vertical support plate may be mounted adjacent to a first end of the first and second longitudinal support members, the vertical support plate having a height and a width. The vertical support plate can be fixed in position against force applied in a longitudinal direction bracing running diagonally to the longitudinal support members. A laterally extending support member may be mounted to the first end of the first and second longitudinal support members, the horizontal support member being connected to the vertical support plate to provide buttress and associated end of the container over a substantial portion of the height of the vertical support plate and adjacent a portion of the container wall, preferably extending upwardly from the bottom at least to the bracing and optionally higher.

First and second lateral support members may also be provided. The first lateral support member may be connected to the first ends of the first and second longitudinal support members, and the second lateral support member may be connected to the second ends of the first and second longitudinal support members. The first and second lateral support members each may have a pair of vertically oriented projections disposed at lateral distal ends thereof, the vertically oriented projections being sized and shaped to be received within recesses of corner fittings of the bulk or waste material container to center the container on the reinforcing chassis. Thus, arranged, when the bulk or waste material container is supported on the first and second longitudinal support members with the vertically oriented projections received within the corner fittings, the vertical support plate may abut an end of the container so that the vertical support plate and the horizontal support member provide horizontal support to the end of the container against loads applied to the end of the container from inside the container.

DETAILED DESCRIPTION

Figure 1:
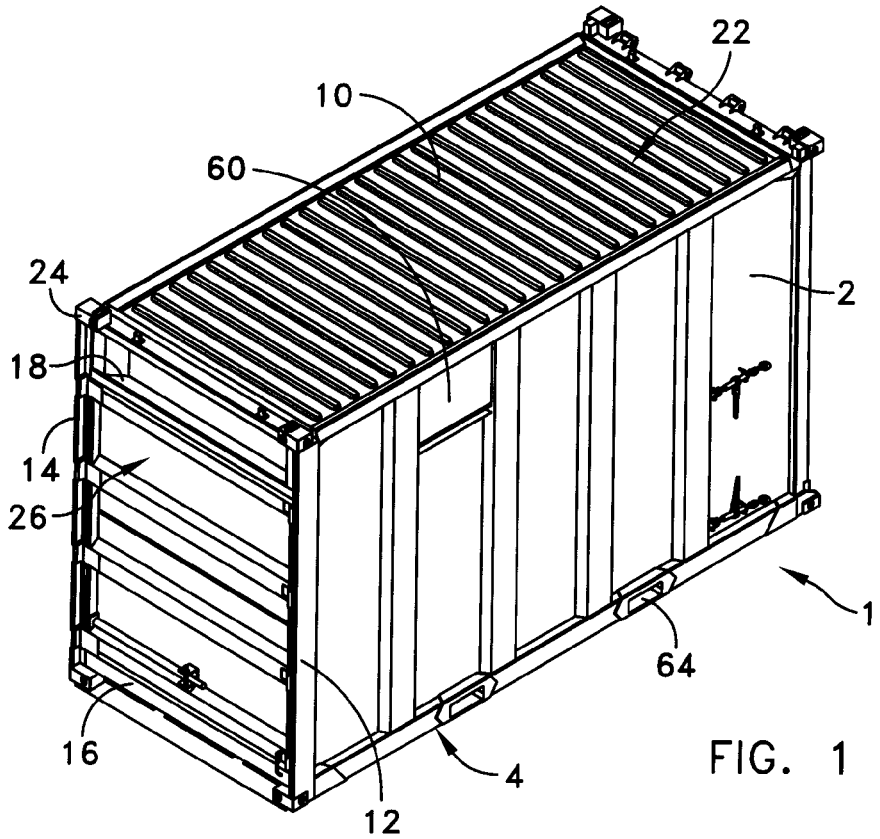
FIG. 1 is a perspective view of an embodiment of the container of the invention, in this example including intermodal container standardized fittings.
Figure 2:
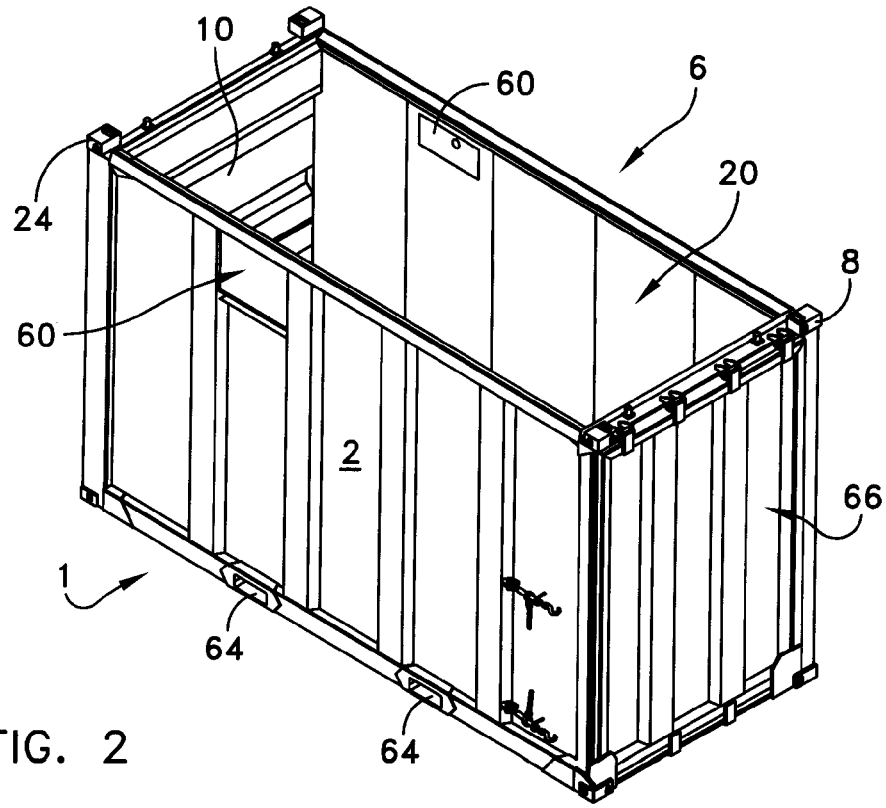
FIG. 2 is a reverse-perspective view of the intermodal container of FIG. 1 with the lid removed, showing the top opening.

Referring to FIGS. 1 and 2, a container 1 such as an intermodal type bulk container for solid waste transfer is generally a rectilinear box and has a container body defining at least side walls 2 and a bottom 4, the example shown also having a top 6. The container body is supported by a number of frame elements that need not be described in detail, the frame elements most pertinent to this disclosure being those associated with the container end closures provided by a loading opening 8 and a discharge opening 10. The openings 8, 10 could potentially be in a side wall, but in the preferred example shown the openings 8, 10 substantially occupy opposing ends of the container 1. Thus, the respective frame elements forming the loading opening 8 comprise spaced vertical frame elements including a hinge side frame or jamb element 12, a latch side frame element 14, a sill or bottom side frame element 16 and a header 18. The container 1 may also have a top opening 20 with a removable lid 22. As will be appreciated, materials may be loaded into the container either from the side (via the loading opening 8) or via the top (via the top opening 20). Thereafter the door/lid may be sealed an the container transported to an offloading site, whereupon the contained materials may be unloaded from the side (via the discharge opening 10).

The respective corners of the container shown are outfitted with standard intermodal fittings 24 that are spaced and configured for use with different types of handling equipment. The invention is not limited to intermodal containers, however, and is likewise applicable to custom sizes and types such as roll-on/roll-off containers, compactor containers and other sorts.

Figure 3:
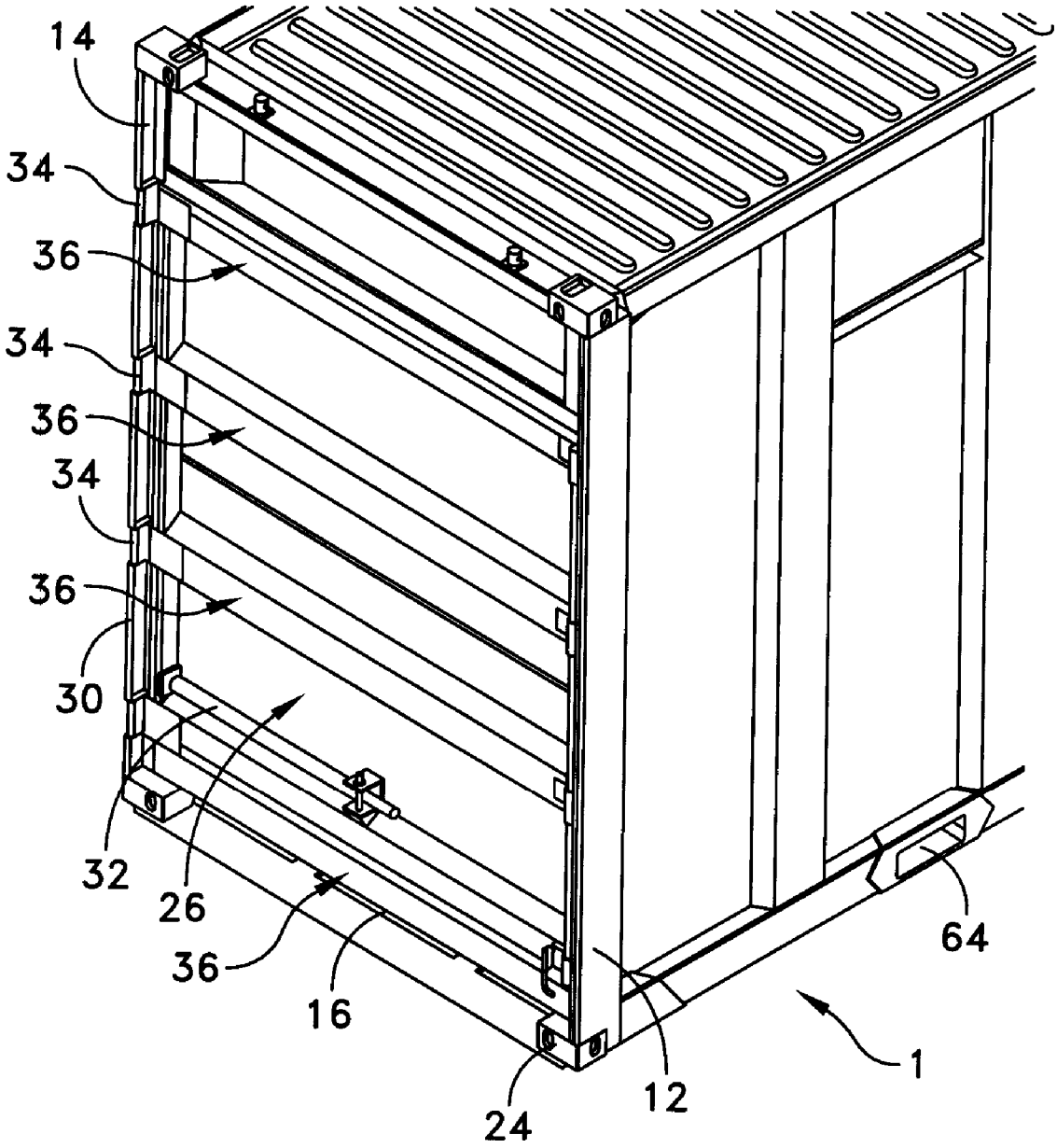
FIG. 3 is a perspective view of the dedicated loading door of the container of FIG. 1, shown in the closed position.
Figure 4:
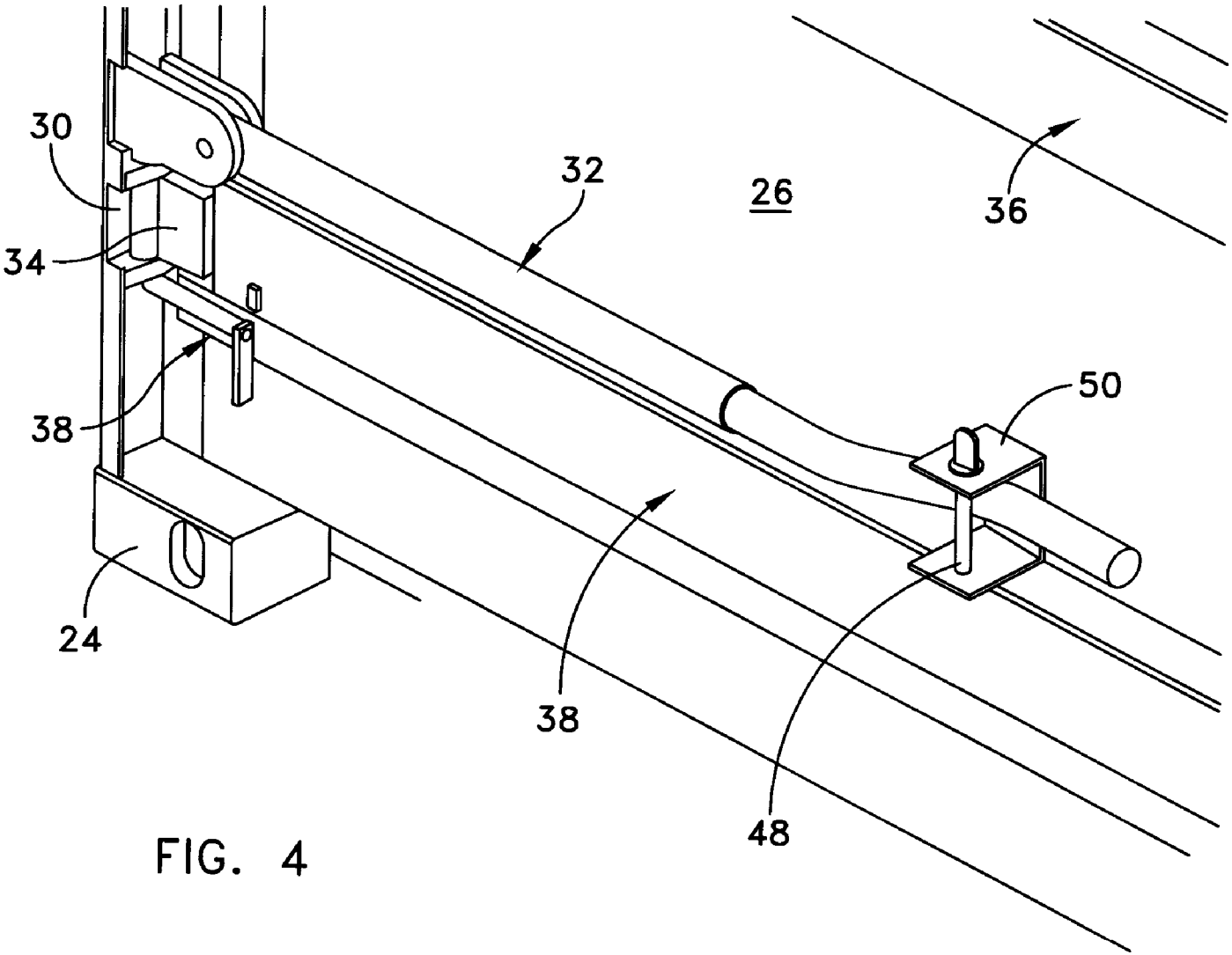
FIG. 4 is an enlarged partial perspective view of the dedicated loading door of FIG. 3, showing details of the closure structure and mechanisms.

As shown in more detail in FIG. 3, the loading opening 8 is covered by loading door 26, which is shown in its closed position and preferably sealed. The loading door 26 is sized to fit the loading opening 8, the door 26 being hinged relative to the frame at the hinge side frame element 14 and being movable to occupy the loading opening 8 by hinging around the axis of one or more hinges thereon.

Figure 5A:
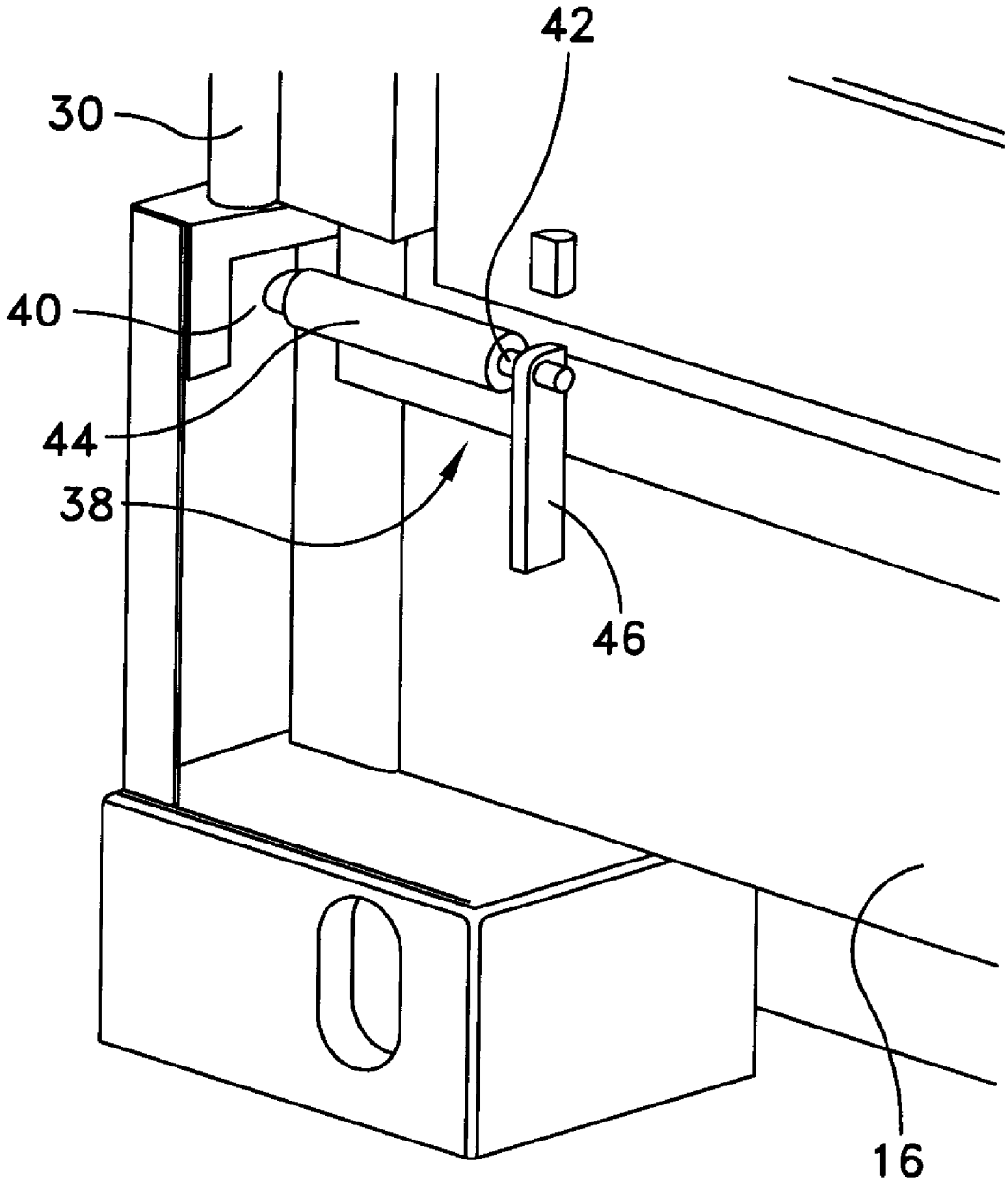
FIGS. 5*a* through 5*f* are perspective views of the dedicated loading door of FIG. 3, showing the sequence of steps for unlocking and opening the door.
Figure 5B:
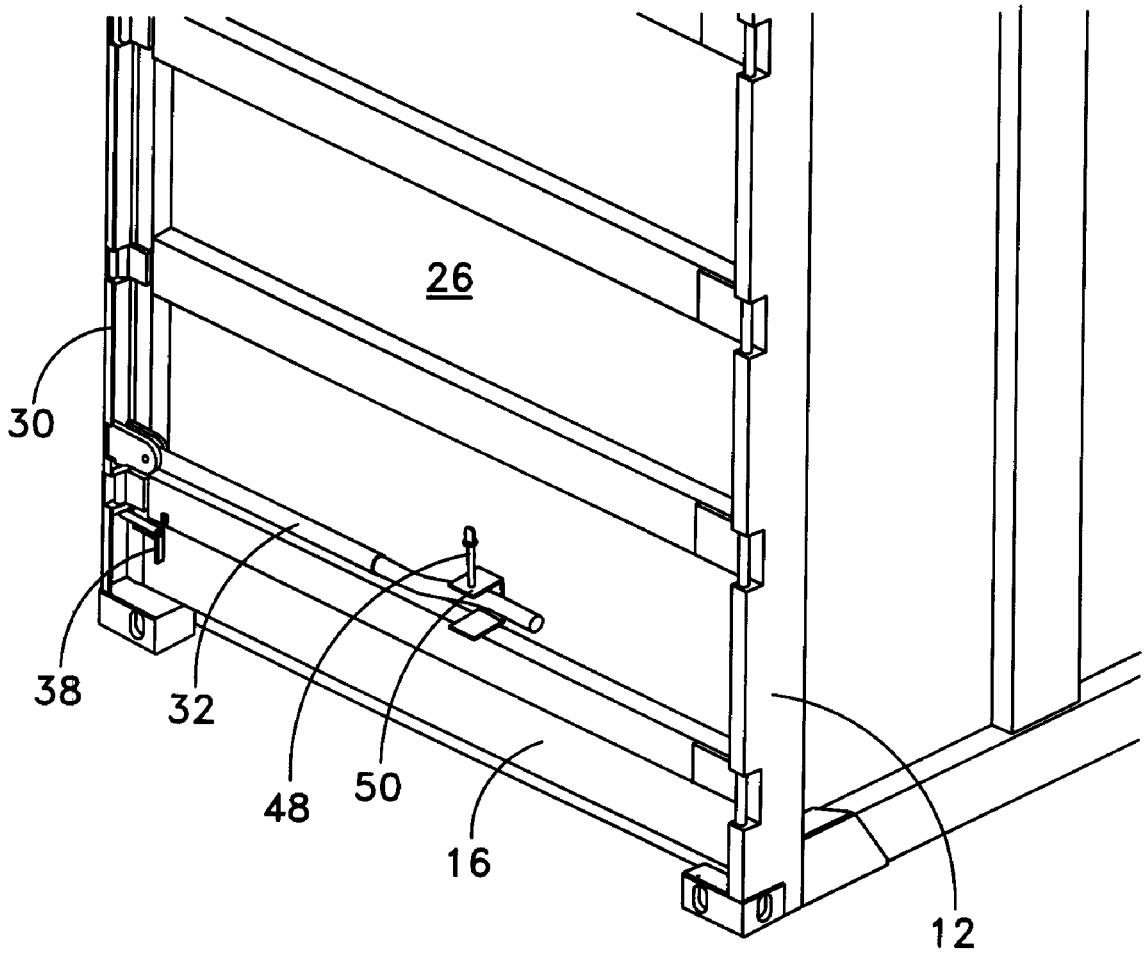
Figure 5C:
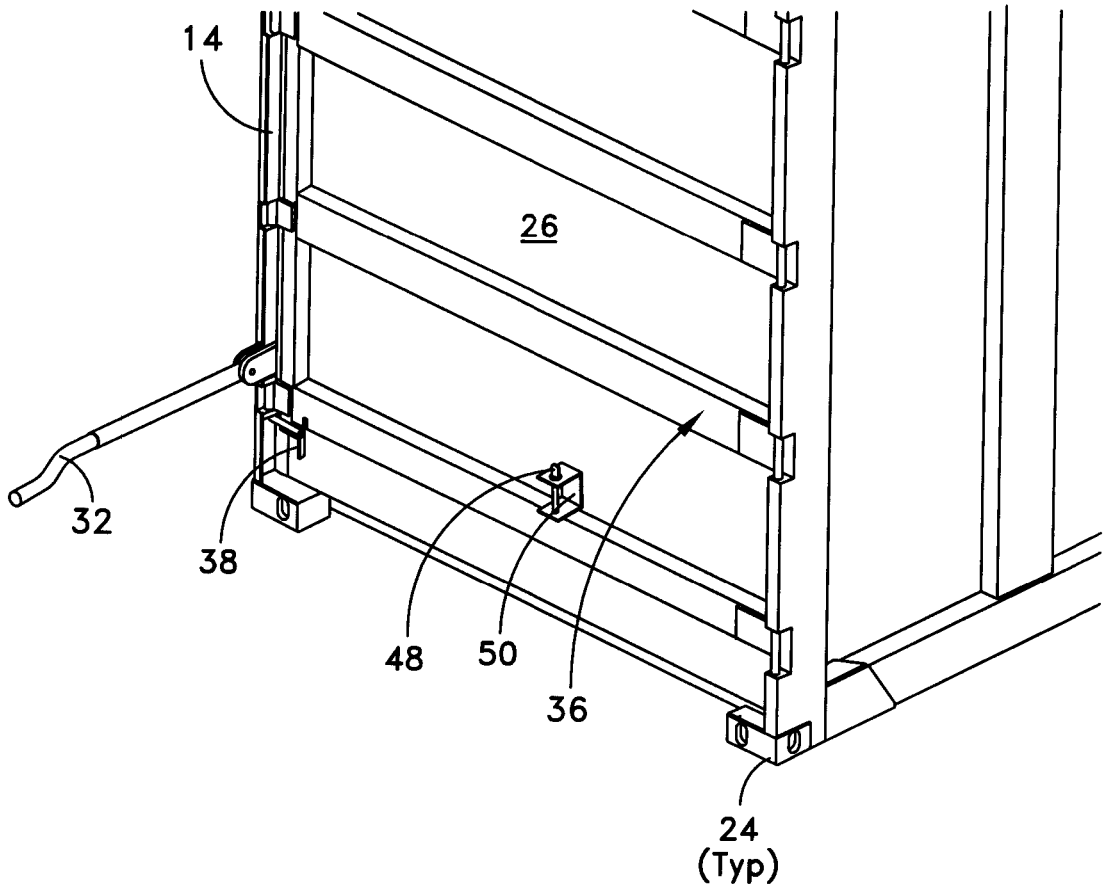
Figure 5D:
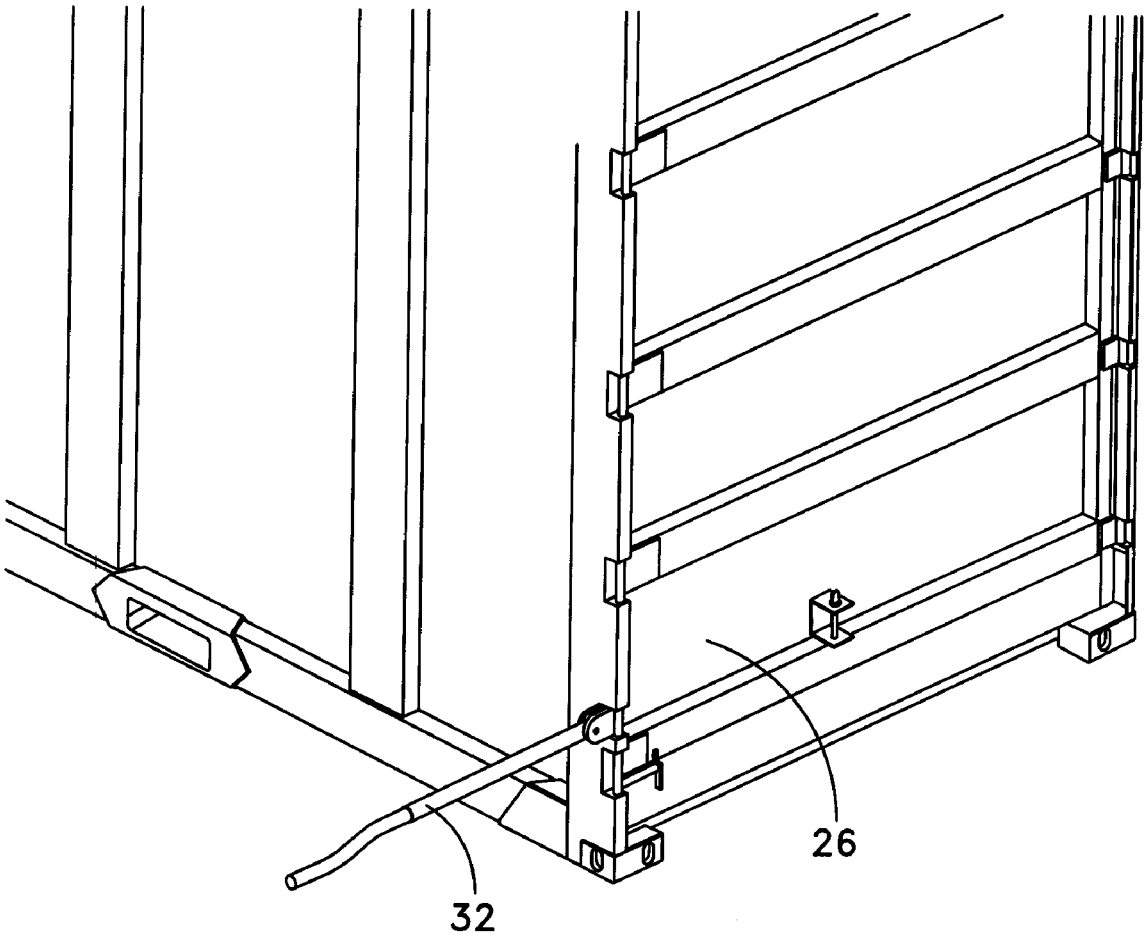
Figure 5E:
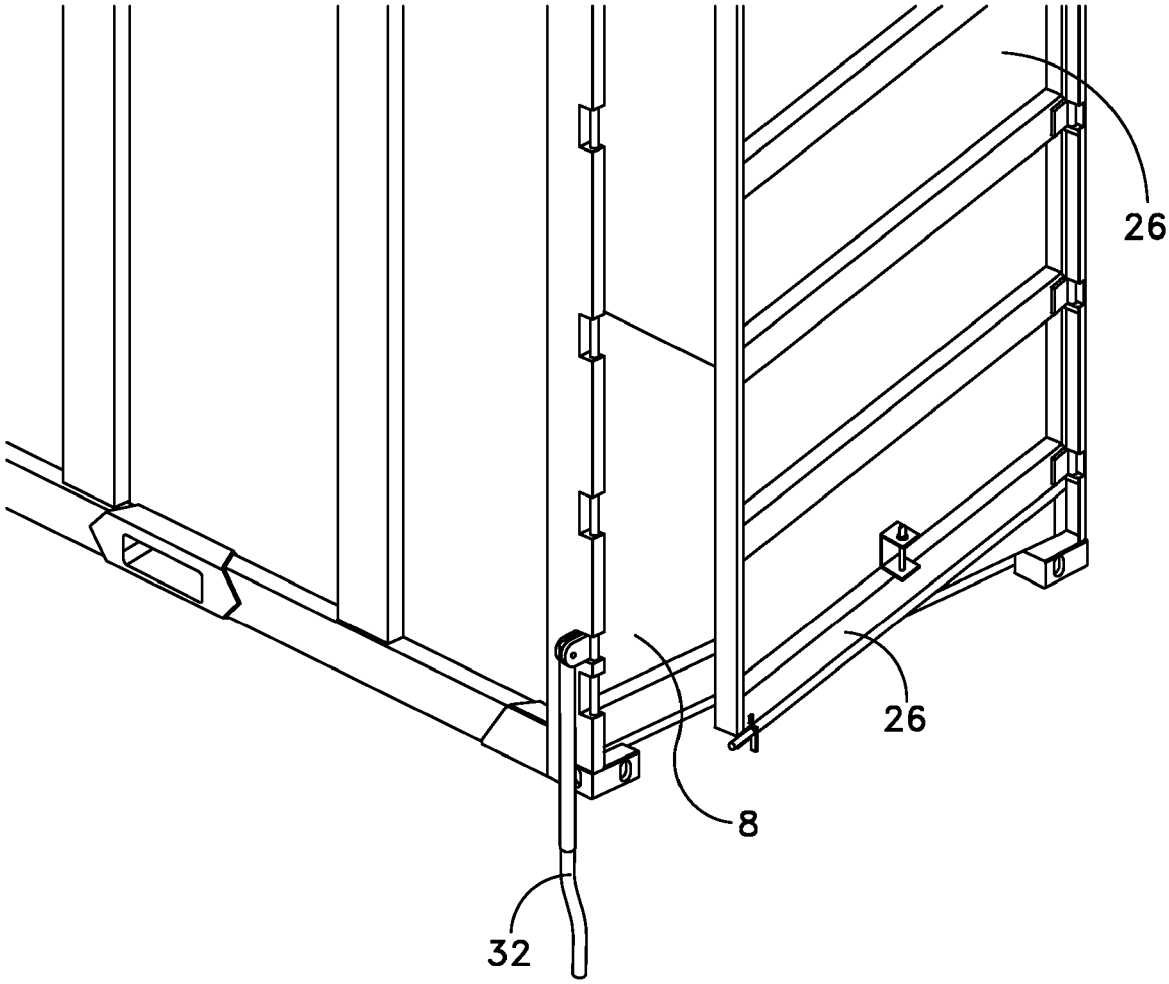
Figure 5F:
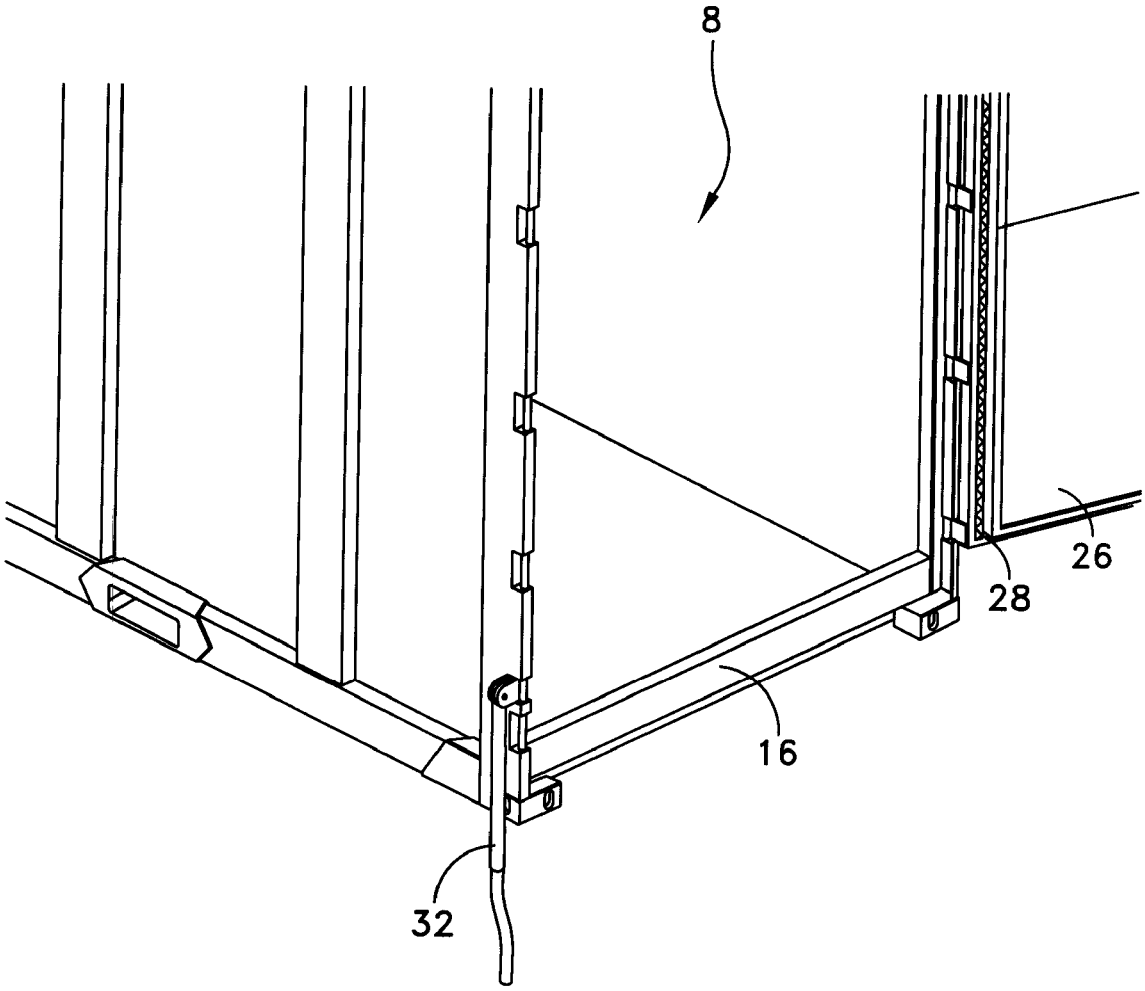

A compressible sealing gasket 28 (FIG. 5*f*) may be carried by either the loading door 26 or the frame elements 12, 14, 16, 18 (in FIG. 5*f* a gasket is shown carried by the door). The gasket 28 can be a solid or celled rubber or polymer material as known in the art. The gasket is compressed between the loading door 26 and the frame elements 12, 14, 16, 18 when the door is closed and sealed. Inasmuch as the container is a rather heavy duty apparatus, the seal is stiff, durable and requires substantial force to compress to the operative sealing pressure needed when the container closure is sealed, i.e., when the door 26 occupies its container closing position in the door opening. On the other hand, in order for the container to be effectively sealed, the seal position and compression advantageously remain precise.

The loading door has a closure mechanism that employs complementary arrangements for urging the loading door 26 against the frame elements 12, 14, 16, 18 thus to compress the gasket 28. Along the edge opposite from the hinge, namely at frame element 14, the closure mechanism has a cam-engaging clamping rod 30 operated by a lever handle 32 that can be pivoted up from the plane of the loading door 26 around an axis parallel to clamp rod 30.

Clamping rod 30 is mounted on the surface of door panel at the corresponding non-hinge edge and presents tabs 34 for engagement with raised structural members 36 of the loading door 26. Rotation of clamping rod 30 advances or retracts tabs 34, which comprise flaps or projections welded on the clamping rod at spaced intervals. The clamping rod 30 is rotatably supported on the frame element 14 by bushings (not shown).

At the same time, the structure has an intermediate state wherein the loading door 26 is held slightly ajar, leaving a space, or at least such that the loading door 26 is held against the gasket 28 at a sealing pressure that is less than the operative sealing pressure, while the clamping rod 30 is coupled and operated. Thus, at least one spring biased catch device 38 is mounted at the free edge of loading door 26. The catch device 38 (shown in more detail in FIG. 5*a*) has a tenon that is biased to extend toward a channel 40 in frame element 14. However, the catch device 38 passes an outer surface of frame element 14 at a position in which the loading door 26 is still ajar. In order to rotate the loading door 26 into a position at which the catch 38 passes and locks in frame element 14, the operator must compress the gasket 28, particularly in the area near the hinge side. This can be very difficult due to the stiffness of the gasket 28. In order to move the loading door 26 to a position wherein it is close enough to cause the tabs 34 to press against the structural members 36 of the loading door 26 must be brought to a position against and at least partly compressing gasket 28.

The catch device 38 may include a lock pin 42 biased in a bushing 44 by a washer (not shown). A back end pull lever 46 or a similar structure is provided so that the pin 42 can be pulled into a retracted position for releasing the pin. The pull lever 46 can have an associated holder where the pin can be held as retracted. Alternatively, the pin can be retracted momentarily. Preferably the nose of the pin 42 is rounded or inclined so as to be pushed back when encountering an obstruction.

Thus, with the noted arrangement, it is possible to more or less slam the heavy loading door 26 against the gasket 28, compressing the gasket 28 momentarily due to the inertia of the hinging door 26. If the timing is just right, the clamping rod 30 can be rotated using by the operator using handle 32 at exactly the right moment to cause the tabs 34 to engage the structural members 36 of the loading 26, and also immediately to press lever handle 32 down into the position shown in FIG. 3. This timed and coordinated operation is difficult to achieve. However if the loading door 26 is simply "slammed" when the handle 32 is in the open position, the catch device 38 operates, thus capturing the pivoting door panel at a position that is slightly ajar and places the tabs 34 in position to engage the structural members 36 of the loading door 26 without any complicated timing or the like. The closure mechanism holds the door 26 against the gasket 28 at a sealing pressure that is less than the operative sealing pressure.

Accordingly, the closure mechanism as shown has a catch device 38 for holding the door 26 to one of the frame elements 14, 16, 18, remote from the hinge side 12. The catch device 38 engages prior to the loading door 26 reaching the closing position at which the gasket 28 is fully compressed. A benefit of making the catch device 38 spring biased is that it will engage and position the door panel in an intermediate state after the loading door 26 is momentarily moved toward the closing position beyond the intermediate state. That is, slamming the loading door 26 positions it for engagement of the catch device and the catch device is placed to hold the door 26 where needed to operate the mechanical clamping aspects of clamping rod 30, and to place tabs 34 in position to engage the loading door 26. At that point, the door closure mechanism is operable to advance the door 26 from the intermediate position ajar, to the closed position.

For this purpose, as noted the door closure mechanism comprises rotatable clamping rod 30 having at least one tab 34 and preferably a series of tabs 34 as shown. These are operated by the manual lever handle 32 which extends radially from the clamping rod 30. In the preferred arrangement, the clamping rod 30 is disposed on an edge of the door parallel and opposite from the hinge axis, namely at frame member 14. It would be possible alternatively or additionally to provide a similar structure on one of the other edges, such as the header or top frame member 18.

Referring to FIGS. 5*a*-5*f*, the steps for opening the loading door 26 will be described in greater detail. First, the catch device 38 is retracted from its engagement with the frame member 14 by grasping and pulling back on the pull lever 46. The manual lever handle 32 may then be released from its locked or "captured" position by removing a retainer pin 48 from its locked position within handle yoke 50 (FIG. 5*b*). The lever handle 32 is then rotated outward toward frame member 14, (FIG. 5*c*) thus causing the clamping rod 30 and its associated tabs 34 to rotate away from the loading door 26. When the lever handle 32 has been rotated to a degree sufficient to ensure that the tabs 34 do not interfere with the loading door (FIG. 5*d*), the lever handle 32 may be rotated downward (FIG. 5*e*) and the loading door opened (FIG. 5*f*).

When the loading door 26 has been opened, the container 1 is ready to receive materials via the loading opening 8. In the embodiment illustrated in FIGS. 6*a*-6*g*, a compaction apparatus 52 is connected directly to the loading opening 8 to discharge a compacted mass 56 of waste material (see reference 56 in FIG. 6*c*) into the container 1. The mass 56 may be more or less cohesive, may be formed in a continuous progression or a serial succession of masses, etc. Such a mass can be termed a "bale" or a "slug" although there are any number of possibilities for the material composition, whether it is relatively loosely or tightly packed, the optional provision of strapping, etc.

Figure 6A:
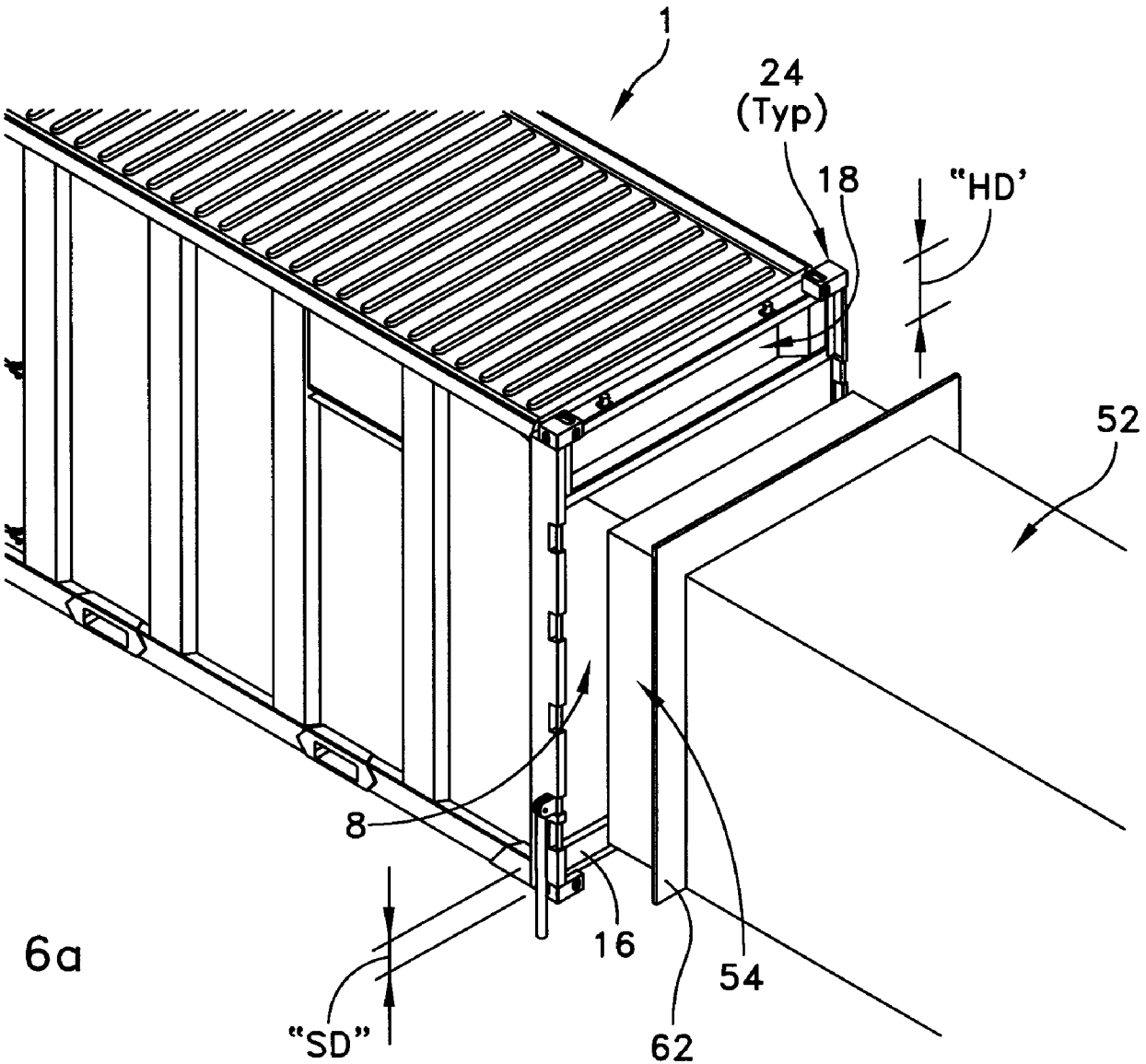
FIGS. 6*a* through 6*f* are partial perspective views of the container of FIG. 1, showing the sequence of steps for engaging an output end of a waste compactor; accepting a slug of compressed material through the dedicated loading door of FIG. 3; then disengaging from the waste compactor and closing the loading door.

The loading opening 8 preferably is designed to mate with the discharge end of a standard waste compaction apparatus 52. For this purpose, the container is arranged to have the necessary dimensions, structure and positioning arrangement so as to be held in place during loading on or immediately adjacent to the apparatus 52 at the discharge thereof. As shown in FIG. 6*a*, the loading opening 8 may be defined by a header 18 at the top and a sill 16 at the bottom. The header 18 may project a distance "HD" vertically downward from the top of the container. The sill 16 may project a distance "SD" vertically upward from the bottom of the container.

The arrangement of the header 18 and sill 16 may be customized or altered as desired to ensure a satisfactory "fit" between the discharge end 54 of the compaction apparatus 52 and the loading opening 8 of the container 1. Likewise, although not shown, it is envisioned that structures could also be provided at the side edges of the container to conform if the output end 54 of the compaction apparatus 52 is substantially narrower than the width of the container 1.

The header 18 and sill 16 arrangements offer advantages in addition to that of allowing close mating between container and the compaction apparatus 52. Thus, the downwardly descending header 18 creates a void space 58 (FIG. 6*e*) between the top of the container and the top of the waste slug 56. This void space 58 may advantageously be filled with additional material (e.g., through top opening 20), or it may be used as a venting volume. Thus, flapper vents 60 (FIGS. 1, 2) may be provided near that top of the container 1 to allow gases generated within the compressed slug to be vented outside the container. Since the ends (and top) of the container are sealed with gaskets, such venting can be useful to relieve unwanted pressurization of the container, e.g., from changes in atmospheric air pressure or internal pressure from solar heating or from gases devolved from the container contents due to decomposition or other causes, which otherwise could be released suddenly when the container is eventually opened.

As with the generation of gas from the slug of waste material, liquids may also be exuded during transfer and transport of the waste material. Thus, a raised sill 16 advantageously can provide a large sump or containment volume for holding liquid that either may leak from the compacted slug during transport or may be ejected into the container by the compaction apparatus when the slug is being transferred into the container 1. In one embodiment, the distance "SD" is about 6.5 inches, which in a standard container size results in a sump or containment volume of about 600 gallons of liquid.

Figure 6B:
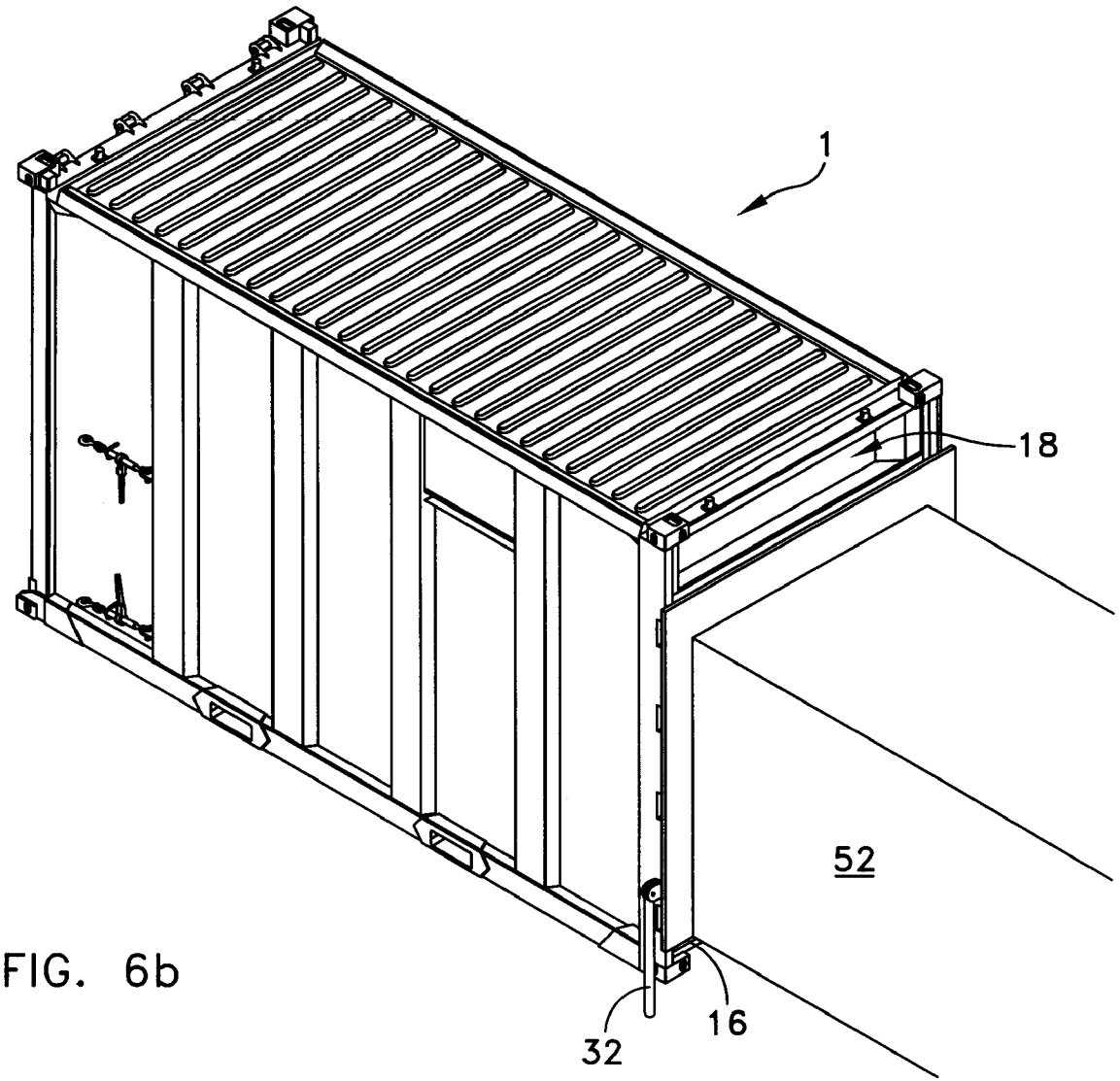

FIG. 6*a* shows the discharge end 54 of the compaction apparatus 52 adjacent to the loading opening of the container 1. In operation, the container 1 may be loaded onto a semi trailer or truck chassis that is backed up to bring the container 1 into engagement with the discharge end of compaction apparatus 52. FIG. 6*b* shows the discharge end 54 mated with the loading opening 8. The compaction apparatus 52 may have a flange 62 disposed about the perimeter of the discharge end 54 to provide a stop surface for defining a relative position of the loading opening relative to the compactor discharge structures. This flange 62 may serve to seal the discharge end 54 against the loading opening 8, and thus a gasket (not shown) may be provided on a seating surface of the flange 62.

Figure 6C:
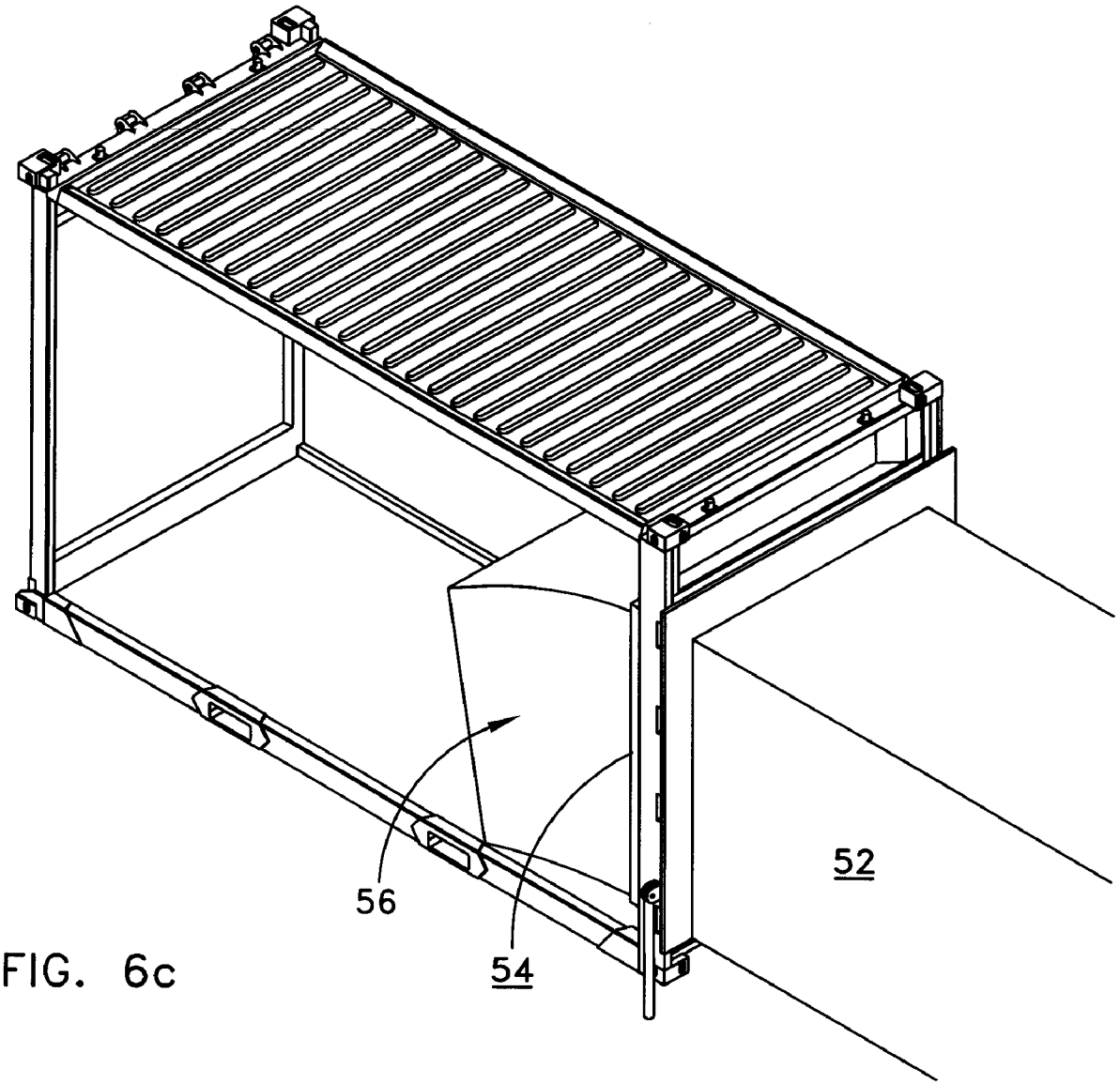
Figure 6D:
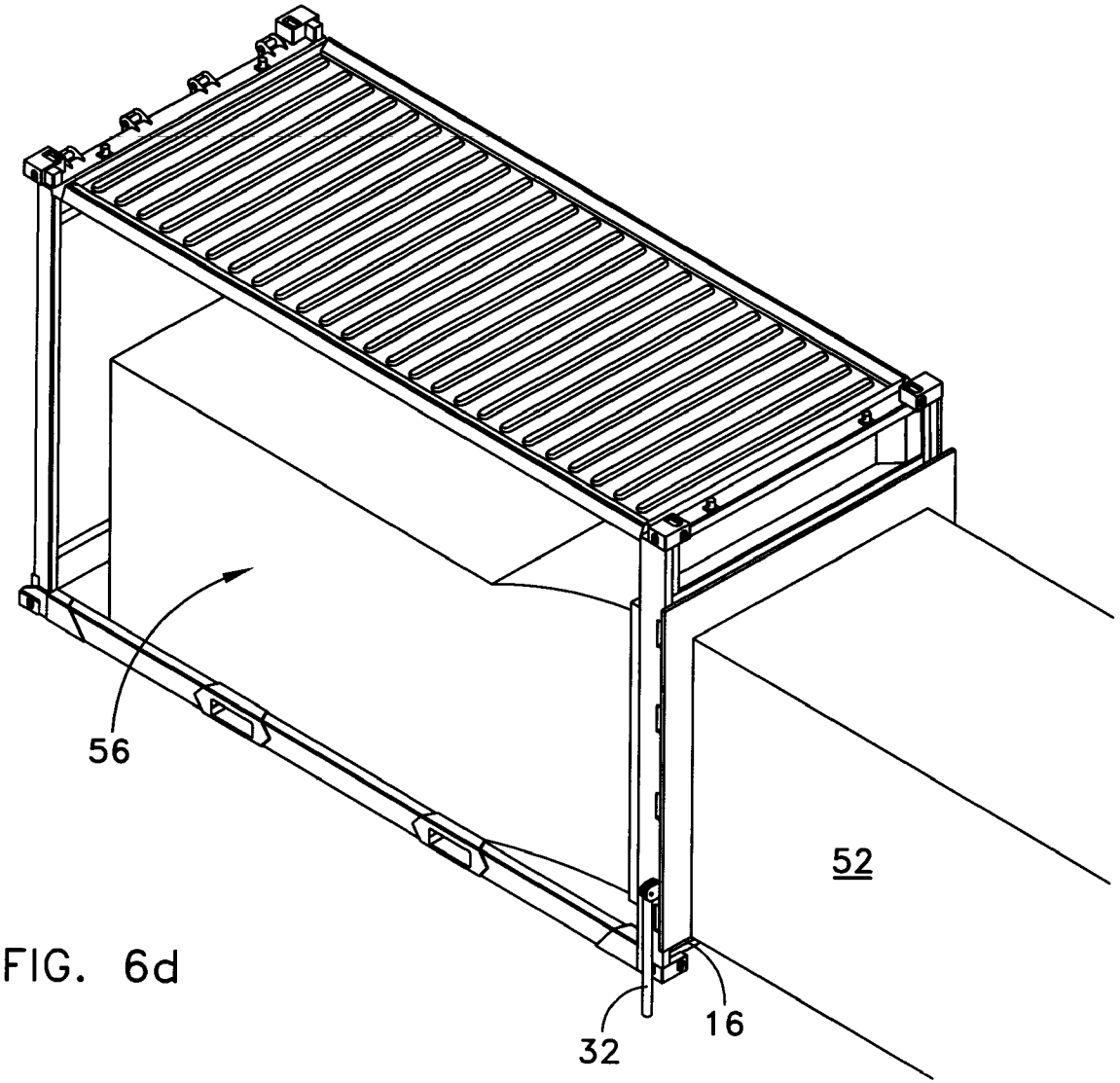
Figure 6E:
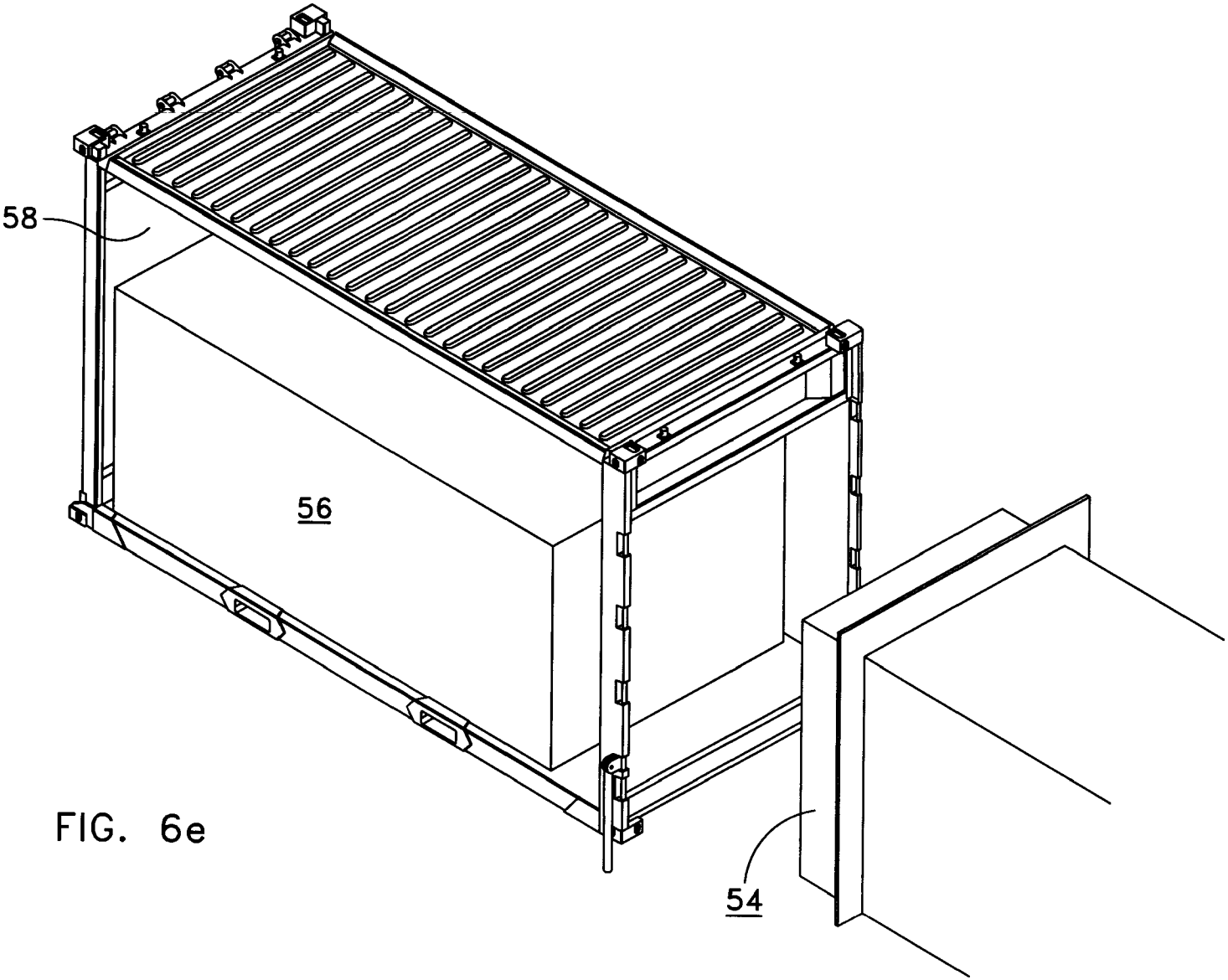
Figure 6F:
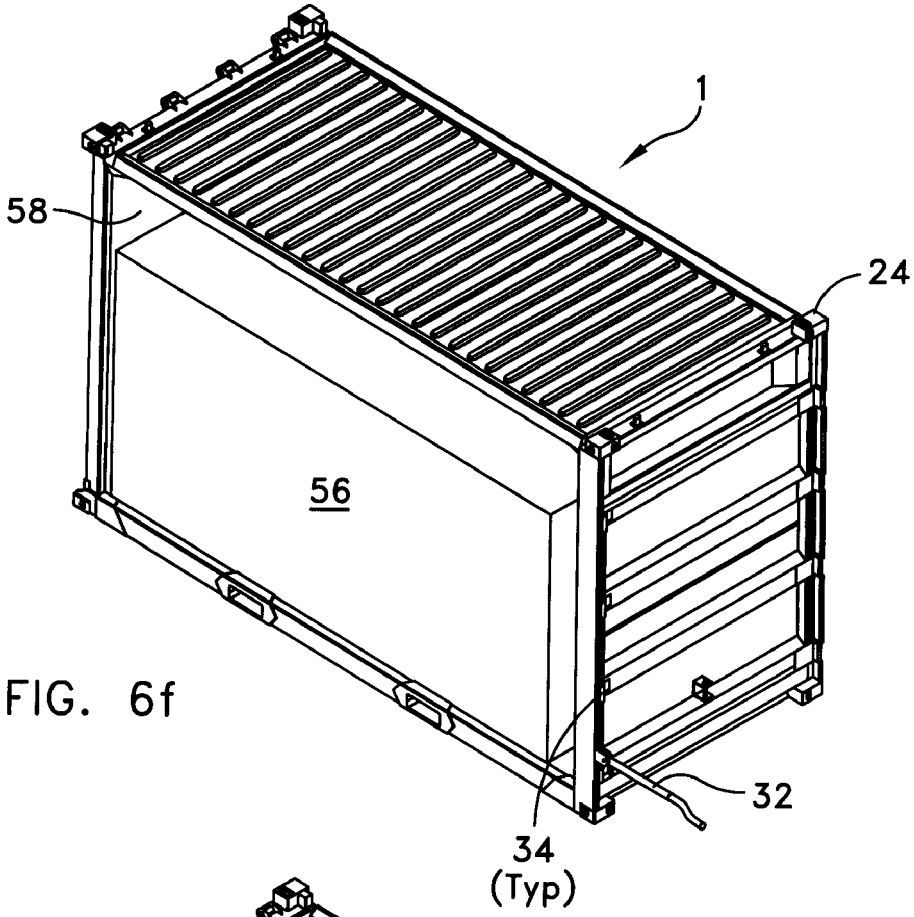
Figure 6G:
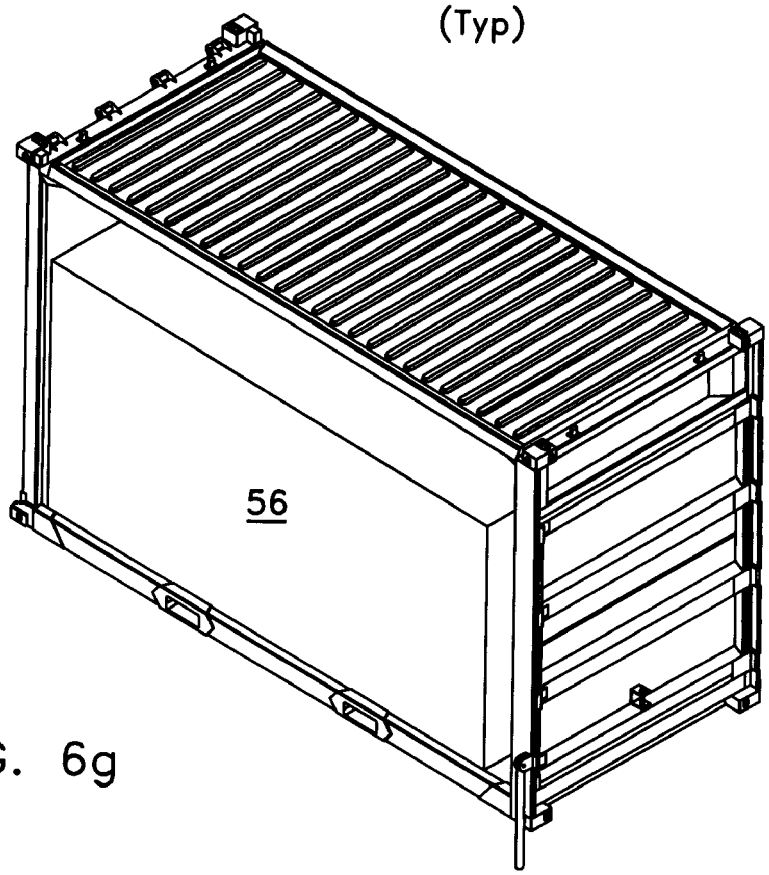

When the compaction apparatus 52 and the container 1 are thus positioned, the waste slug may be pressed into the container, for example by operation of a compactor ram or auger (not shown) applying pressure in a direction toward the container 1. The slug is advanced by the compactor as shown in FIGS. 6*c, d* and *e*. Once a slug has been pushed into the container, which can be a discrete batch load or a portion detached from a continuous stream of compressed material to form the slug, the container 1 may be disengaged from the compaction apparatus 52 and moved away from the compactor in a longitudinal direction by a distance at least equal to the width of the loading door. The loading door then can be pivoted on its hinge and slammed closed (taking advantage of the catch device 38 to provisionally engage the door with the opening). The manual lever 32 may then be rotated inward toward its original position, thus pressing tabs 34 against the structural members 36 of the door 26 to firmly fix the door to the opening and to seal the gasket 28. The lever 32 may then be fixed in a locked position with the handle yoke 50 and the retainer pin 48 reinstalled.

The filled and closed container can be manipulated and transported like any intermodal container. For example, the container may be transported on the same supporting chassis or moved to another chassis and driven by truck to an intermediate or final destination. For example the container might be transported for a substantial overland distance, by driven to a rail yard via truck, lifted via a crane or the like equipped with a standard spreader for intermodal container, placed and affixed on a rail car with standard fittings, transported to an ultimate dumping site or to a site at which the container is moved to and attached to a tilting trailer or the like for dumping.

The manipulation steps for the container are not limited to use of the intermodal fittings. For example as can be seen throughout the figures, a pair of transversely-disposed recesses 64 may be provided in a bottom structure of the container 1, allowing the container 1 to be engaged and manipulated with a fork-truck by placing the fork-truck tines laterally under the container.

Once the filled container has been transported to the dumping site, usually on the chassis of a truck or semi trailer, the contents may be discharged via the dumping opening 10 on the end opposite from the loading end, by tipping the container 1 to lower the dumping opening end relative to the loading end (or raise the loading end relative to the dumping end, or both), to move the slug or other contents out of the container 1 under force of gravity.

Figure 7A:
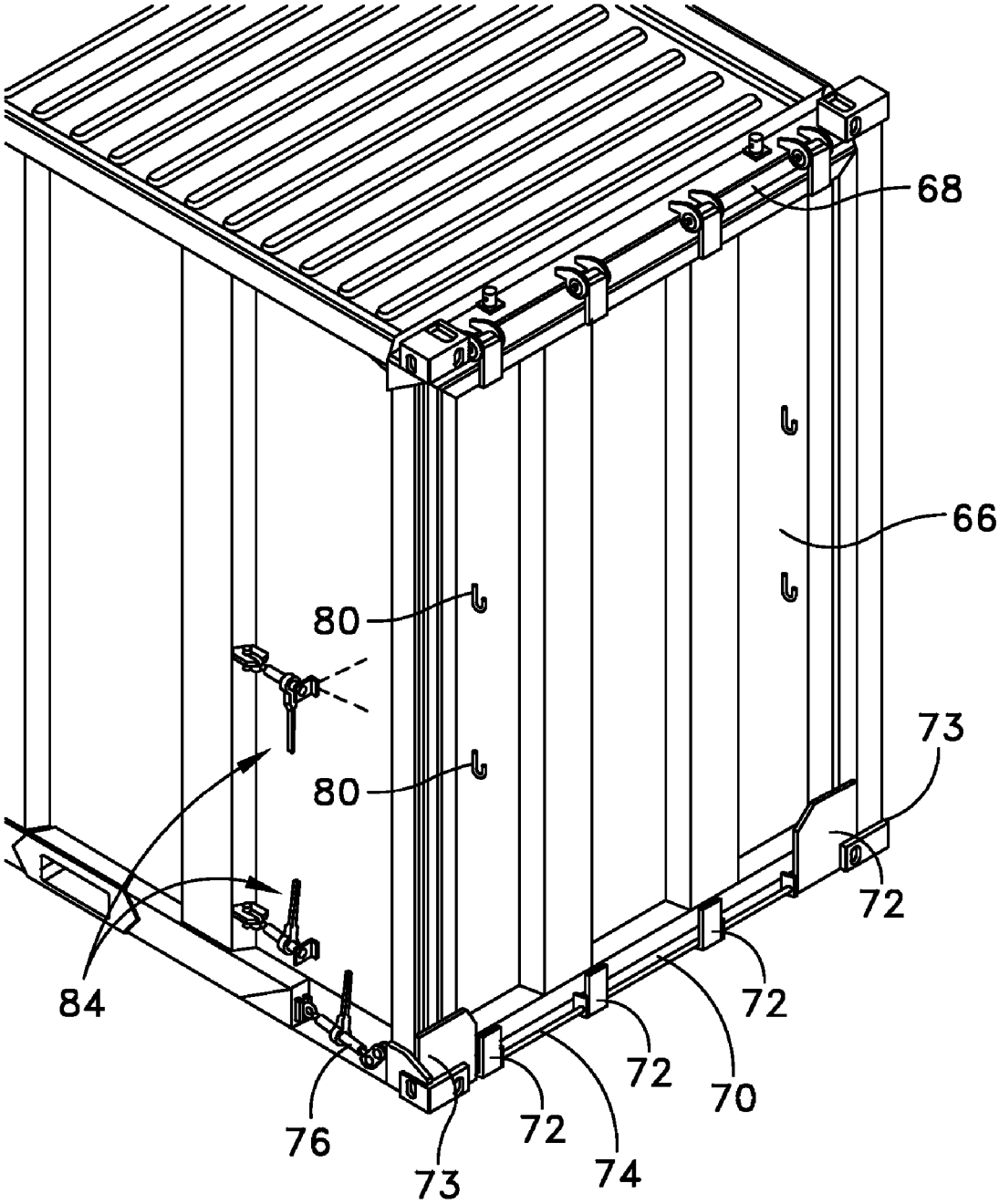
FIG. 7*a* is a perspective view of the dedicated dumping door of the container of FIG. 1, shown in the closed position.

Referring to FIG. 7*a*, the dumping opening 10 is covered by discharge door 66, which is shown in its closed and sealed position. The discharge door 66 is sized to cover the discharge opening 10, and is hinged relative to the frame at hinge top post 68. The discharge door 66 is movable to occupy the discharge opening 10 by hinging around the axis of one or more hinges thereon.

In the embodiment shown, the bottom edge or sill 70 of the dumping opening 10 has a series of tab elements 72 that are mounted on a clamp rod 74 that is rotatably mounted in the structure of sill 70. Specifically, the tab elements 72 can be rotated upward to engage the outward surface of the discharge door 66 to clamp the discharge door 66 against the gasket (not shown) and associated side and top frame structures. (It is noted that the gasket used for the discharge door may be similar in form and construction to the gasket 28 used to seal the loading door 26.) Conversely, the tab elements 72 can be rotated downward using the clamp rod 74 to disengage the discharge door 66. This leaves the discharge door 66 free to rotate about its hinge to enable contained material to be unloaded through the discharge opening 10. The rotation of the clamp rod 74 can be effected by a suitable hand or power tool, such as by manual operation of a ratchet binder 76 disposed along the side wall of the container 1 to shorten the length of a connection between the rotatable tab elements 72 and a fixed attachment point of a chain on the container body.

The discharge door 66 can be subject to substantial forces during the loading and carriage phases of use. Thus, one or more supplemental locking mechanisms may be used to ensure that the discharge door 66 remains closed and possibly sealed a gasket, if provided. Thus, a plurality of chain supports (shown as dashed lines in FIG. 7*a*) may be used to bind the discharge door 66 to one or both sides of the container. As shown in FIG. 7*a*, a plurality of chain engaging hooks, rings, etc. 80 may be provided on the discharge door 66. These chain hooks 80 may engage a link, hook, ring or other suitable structure attached to an appropriately sized chain or other flexible link. The opposite end of the chain or link may be connected to a clamping mechanism 84 fixed to the side of the container 1. Thus, once the discharge door 66 has been closed, the chains may be engaged with the discharge door 66 and the clamping mechanisms engaged to tightly clamp the door in the closed position. As shown in FIGS. 7*a, b*, the end tab elements 72 may have lateral extensions 73 which may themselves be grasped by a chain and connected to a clamping mechanism 84. This arrangement may prevent the lock rod 74 and tab elements 72 from rotating during container loading and transport operations.

Figure 8A:
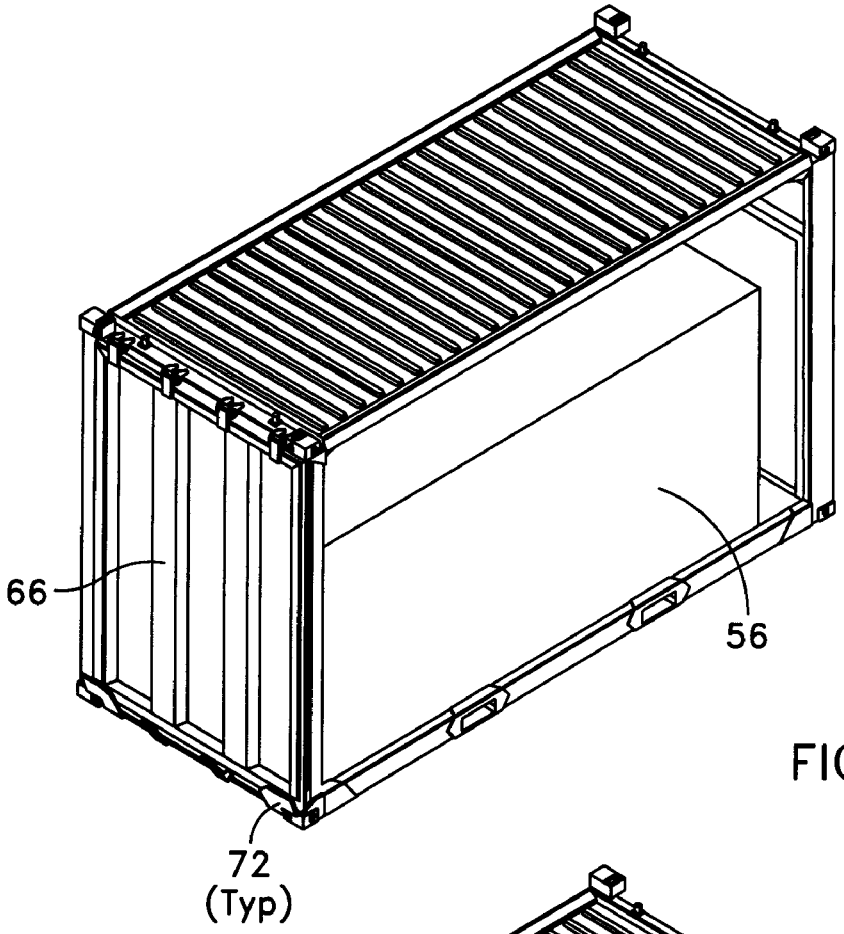
FIGS. 8*a* and 8*b* are perspective views and FIGS. 8*c* and 8*d* are side elevation views of the dedicated dumping door of FIG. 7, showing the sequence of steps for unlocking and opening the door and for dumping waste material through the dedicated dumping door.
Figure 8B:
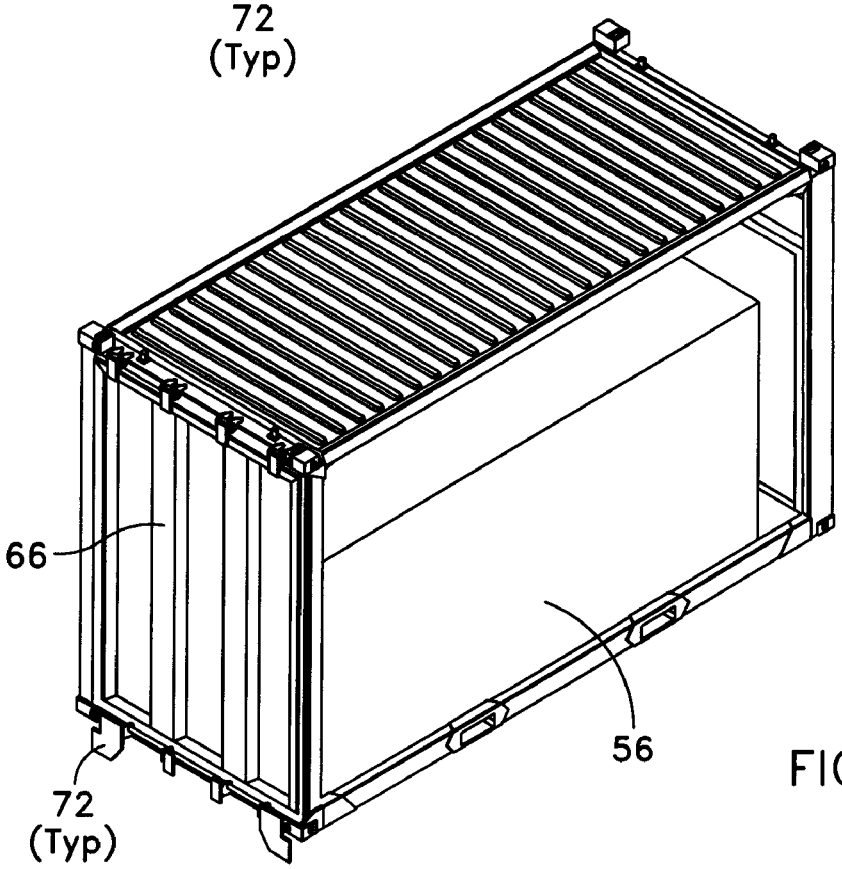
Figure 8C:
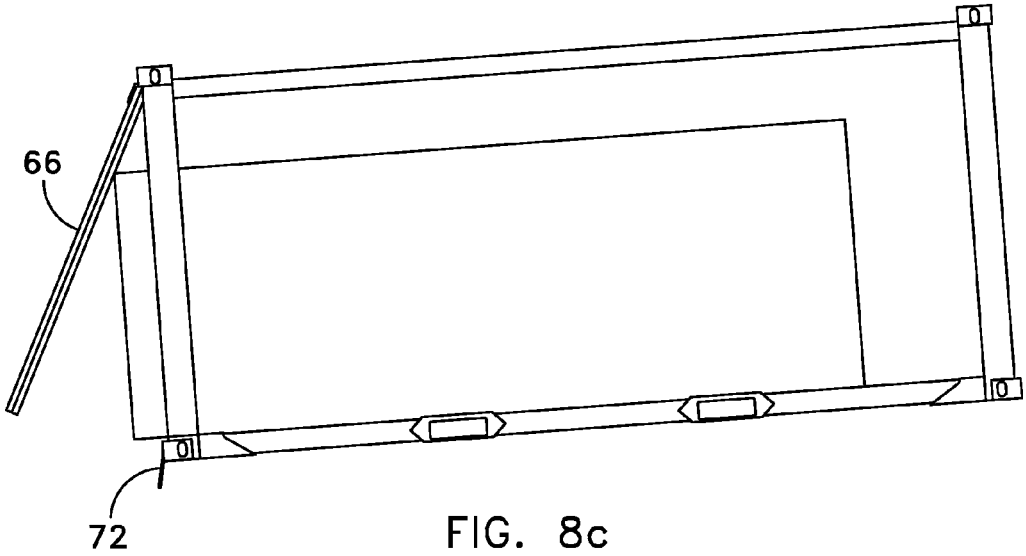
Figure 8D:
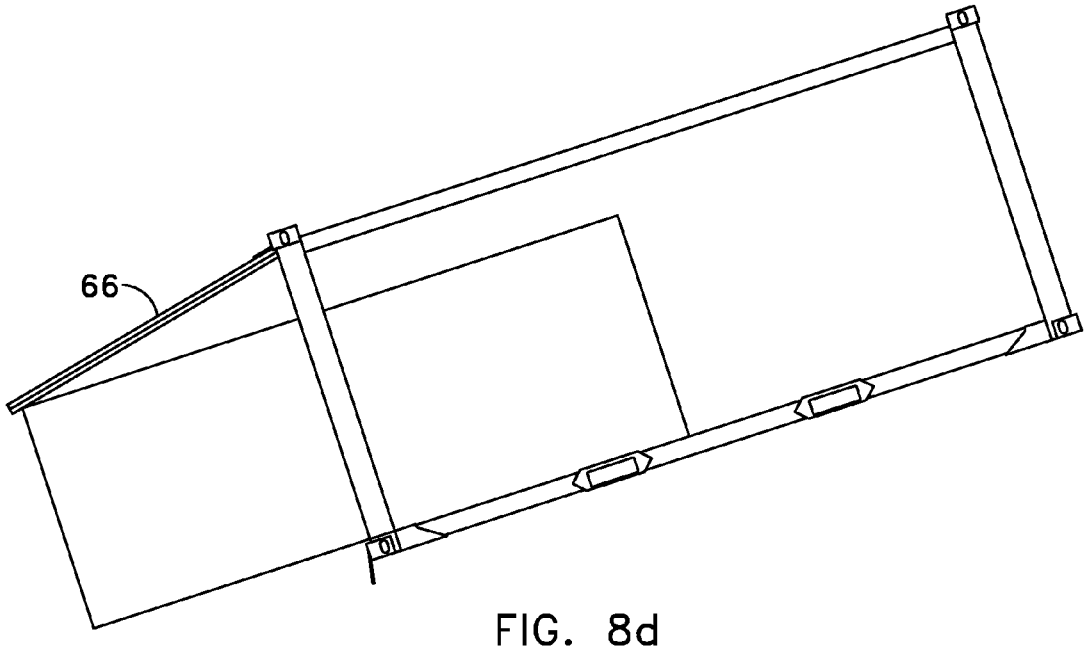

To dump the slug of waste material out of the container, the clamping mechanisms may be released, and the chains removed from their connections to the discharge door 66. The ratchet binder 76 may then be used to loosen the connections to permit disengagement as needed to rotate the lock rod 74 and tab elements 72 away from the discharge door 66 (FIGS. 8*a, b*). Once the tab elements 72 are swung sufficiently free of the dumping door, the loading end of the container (i.e. the end opposite the dumping door) may be raised relative to the discharge end using mechanical or hydraulic means (e.g., a tipping chassis of a truck) (FIG. 8*c*). At a certain point of tilting, gravity overcomes friction and the waste in the container slides toward the dumping door. The weight of the waste against the dumping door is generally sufficient to press the dumping door further open as the waste exits the container (FIGS. 8*c, d*). Additionally, the dumping door swings freely on its hinges and thus pivots open from the frame at the discharge end by an angle determined by the angle of tilting of the container.

Figure 9:
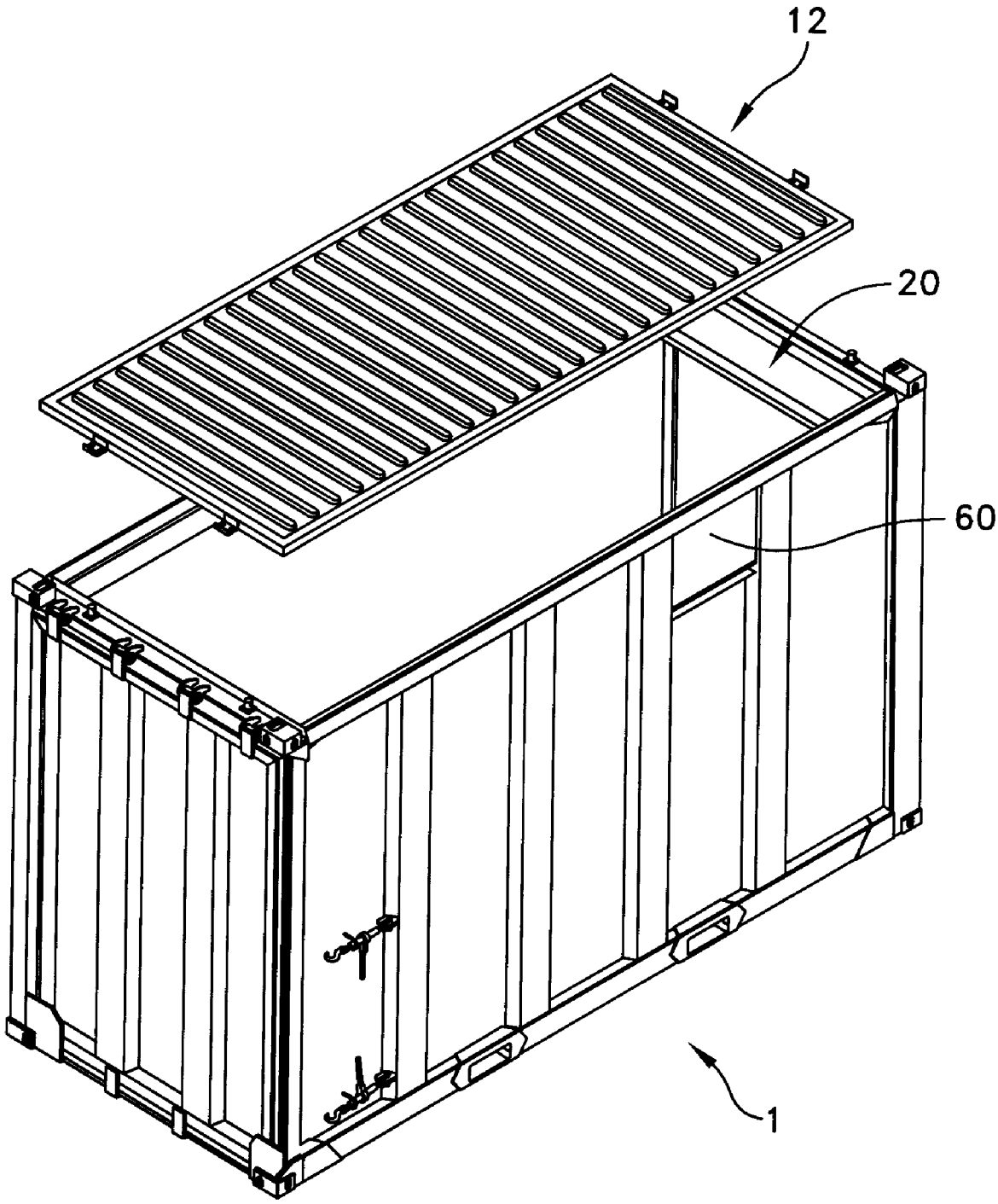
FIG. 9 is a perspective view of the container of FIG. 1, showing the lid removed from the container.

According to an inventive aspect, the container as shown has not only distinct loading and unloading doors, but also is characterized by a top loading feature shown in FIG. 9. The top opening 20 of the container 1, which preferably encompasses a substantial portion of the top wall of the container, can be opened for loading or unloading, by removing a lid 22 to allow bulk or waste materials to be loaded into the container 1 from above. This top-loading feature allows the container to be loaded in a traditional manner by dropping material into the container from above, in addition to the previously described end or side-loading compaction scenario. The top loading feature, together with the end load vertically hinged door and end dump horizontally hinged door, provide a more universally employable container that can be used in a multitude of different loading and dumping applications and which eliminates the need for specialized containers for performing specific loading operations associated with loading or unloading from the top or end, dumping by tilting or potentially by pushing material longitudinally through the container to the discharge end, etc.

In one embodiment, the container 1 as shown in FIG. 9 may be filled with bulk or waste materials by loading through the top opening 20, for example with a front end loader by positioning the container at a product discharge chute from a fixed processing installation. As an alternative, the top opening 20 may be used as an access opening to "top off" the container after a slug of compressed waste material has been introduced into the container via the side loading door 26. The header 18 associated with the loading opening 8 substantially reinforces the structure of the container 1 at the loading end, but defines a maximum height for the discharge from the compactor, and as a result a maximum height of an introduced waste slug, that is less than the total interior height of the container, by a distance equal to the vertical height of the header. Such an arrangement allows more efficient utilization of the interior space of the container, as well as providing multipurpose possibilities for specific ways in which the container can be filled and emptied.

Also shown in FIG. 9 is at least one vent 60 disposed in an upper portion of one side of the container 1 (note that although only one vent is shown, multiple vents can be provided). This vent 60 may be used either to allow accumulated or generated gases to escape the sealed container (as previously described), or to allow air to enter the void space above the waste slug when the slug is dumped. Providing an air path into the void space during dumping of a slug is useful because the container 1 may have a tendency to draw a vacuum as the slug slides out through the dumping door. Providing the air path reduces pressure cycling stress on the container and also facilitates dumping by reducing the fluid drag associated with the inrush of air needed to reoccupy the volume of the departing slug as the slug slides out of the container.

Figure 11:
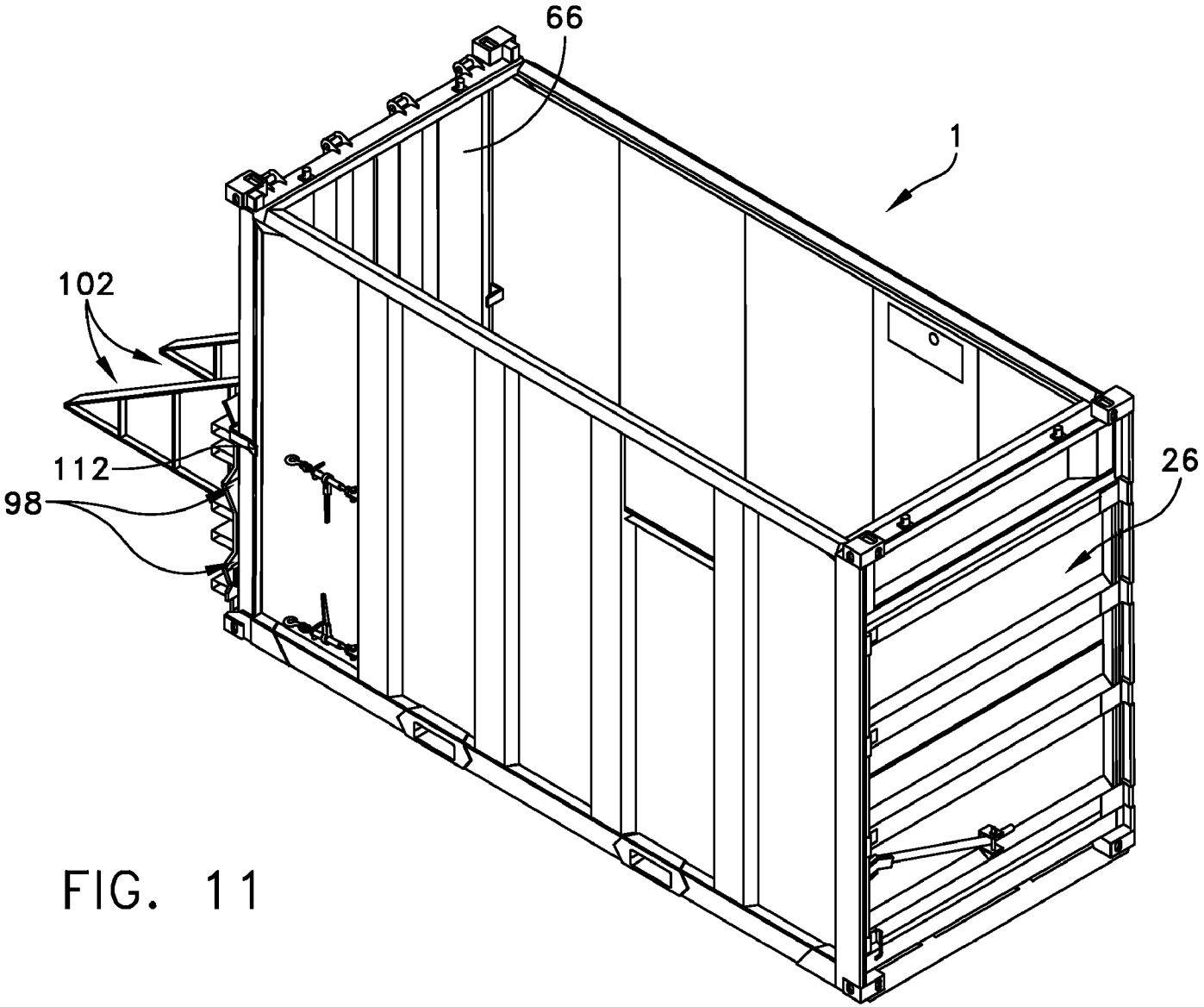
FIGS. 11 and 12 are perspective and reverse perspective views of the reinforcement chassis of FIG. 10 supporting the container of FIG. 1.
Figure 12:
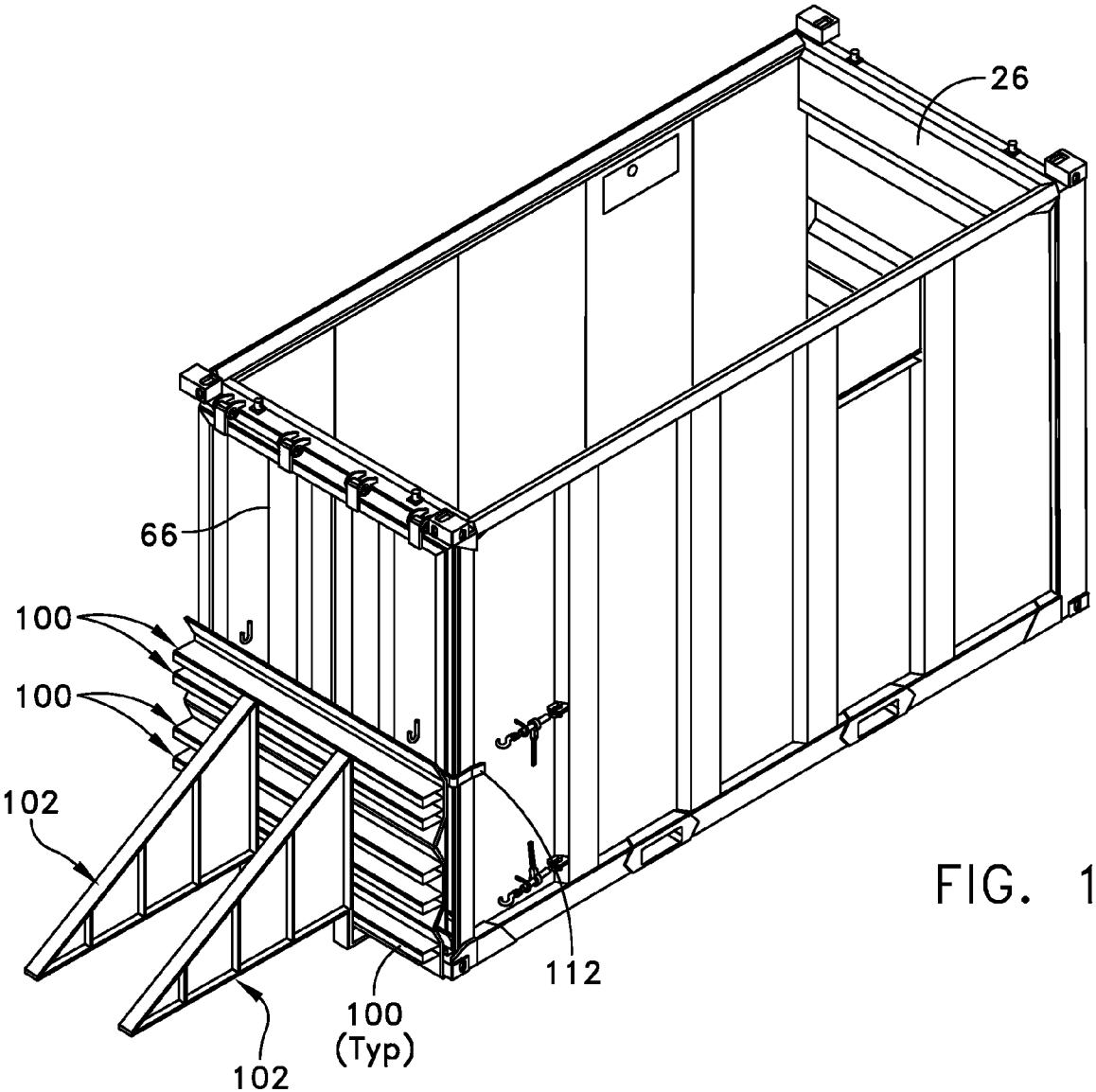

FIGS. 11 and 12 show an exemplary chassis 86 for use with the inventive container 1. This chassis 86 is structured to provide support for the container, and in particular for the dumping door 66 while the compacted waste slug is being transferred into the container. As discussed above, the slug can be moved into the container by operating the compactor to push a quantity of material or a continuous stream of material in the direction of the container, thus bearing eventually on the far end of the container at the dumping door. As shown in FIGS. 6*c* and *d*, the waste slug 56 is ejected from the discharge end of the compaction apparatus 52 into the container 1. This ejection occurs by the force of a compactor ram or auger (not shown). In the case of a ram, the compactor might nominally apply force to the slug up to about 100,000 pounds as needed to compress and move the material through the compactor and into the container as a compressed mass. Due to the potentially fragmentary nature of the waste slug, it may not define a coherent mass as it moves into the container. Typically, a slug may fall apart to a certain degree if unencumbered at the front edge of the slug when entering and advancing through the container. For example, the upper portion may fall or be pushed beyond the leading edge of the bottom, where friction with the contain floor structure resists advance. Thus, compaction of loose and leading material may occur within the container as the entirety of the slug is pressed into the container and against the unloading door. A substantial portion of this compaction force (perhaps as much as 80%) may be directed against the discharge door 66, which is disposed opposite the loading opening 8 and the compaction apparatus 52. And although the discharge door and its fittings preferably are reinforced, long term exposure to such compaction forces may damage the discharge door 66, thus reducing its sealing capacity and even its ability to adequately close off the discharge opening 10.

Chassis 86 may include a pair of longitudinal support members 88*a, b* positioned to support the container 1 thereon. A vertical support plate 90 may be provided at a first end 92*a, b* of the longitudinal support members. This vertical support plate 90 may have a width "W" that is at least as wide as the discharge door 66 to provide support for the door over its entire width. The vertical support plate 90 may have a height "H" that is at least about half the height of the discharge door 66 to provide support over that portion of the door that is most likely to receive the force from the compaction ram.

Figure 10:
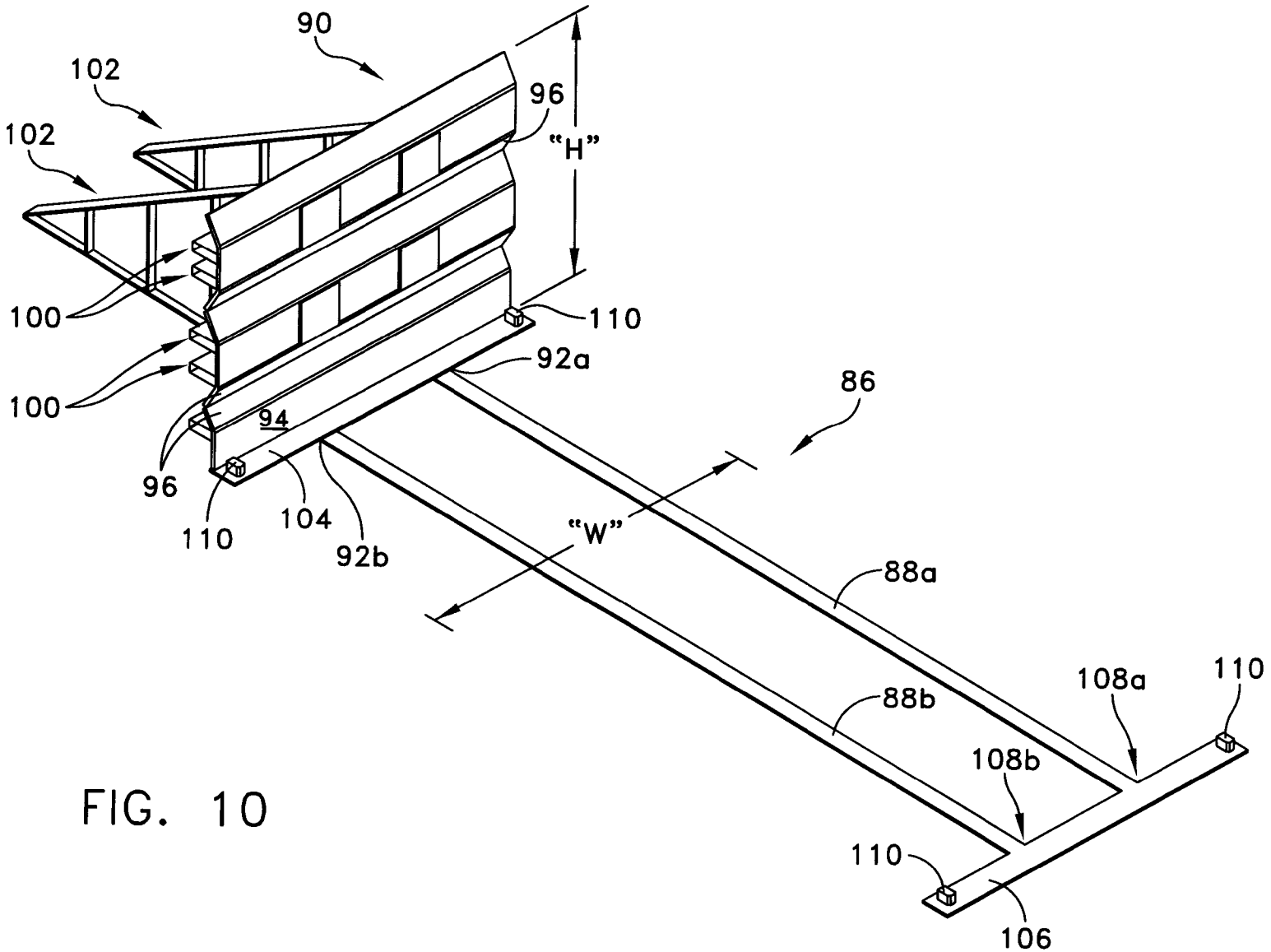
FIG. 10 is a perspective view of a door-reinforcement chassis for use with the container of FIG. 1.

As shown in FIG. 10, the vertical support plate 90 may have a plurality of vertically-oriented surfaces 94 and a plurality of angled surfaces 96 that form recesses 98 therebetween. These recesses 98 may be positioned to correspond with the plurality of chain supports used to bind the dumping door 66 to the side of the container. The recesses ensure that the vertical support plate 90 bears against the dumping door and not the chain supports. The vertically-oriented surfaces may be reinforced by a plurality of structural tubular members 100 which may provide substantial lateral rigidity to the support plate 90. These tubular members 100 may themselves be supported by a pair of angled buffer plates 102. The buffer plates 102 may provide a wide-based connection for the vertical support plate 90 and the tubular members 100 to the chassis, and act to transfer loads from the vertical support plate 90 to the other portions of the chassis or the vehicle of which it is a part.

A pair of lateral support members 104, 106 may be connected to the longitudinal support members 88*a, b* at first and second ends 92*a, b*; 108*a, b* of the longitudinal support members. These lateral support members 104, 106 may be oriented generally perpendicularly with respect to the longitudinal support members 88*a, b* and may be used to provide lateral support to the container 1 supported by the chassis 86. As shown in FIG. 10, the lateral support members 104, 106, may have vertically-oriented projections configured to mate with corresponding recesses of the corner fittings 24 of the container. These projections 110 serve to center the container 1 on the chassis 86 to ensure that the vertical support plate 90 is appropriately located with respect to the discharge door 66. To provide an additional degree of "centering," a pair of support fingers 112 may be provided near the top end of the vertical support plate 90. Theses support fingers 112 may each be configured to cradle a corner/side portion of the container 1 and may prevent relative lateral movement between the container and the support plate 90.

Although the chassis 86 is shown as being a separate assembly, its structures may be integrated into the frame of an appropriate transport vehicle, such as a truck or rail car. The lateral and vertical support members at the unloading end door of the container tend to provide a good connection between the container and the chassis so as to resist the force of the compactor when loading. In some scenarios, it is possible to use pressure tending to push the container on the chassis away from the compactor as an indication that the container is full. Then upon retraction of the compactor, and possibly some rebound from the compressed slug, the chassis is moved a further distance to permit closing of the loading side door.

It is an aspect of the invention that an intermodal style container is provided with plural doors, preferably with doors at both ends and a removable top covered opening. By structuring the container as shown and described, including providing rigid structures at the compactor loading end header, and at the horizontal hinge axis a the dumping end, and by employing the container as described, the container is sound notwithstanding that three of its six rectangular faces are substantially occupied by access doors or covers. Preferably, supporting the dumping end door by providing a force resisting chassis structure is also used as necessary with respect to compaction and slug-advancing procedures.

The invention has been described with respect to certain preferred embodiments, but the invention is not limited only to the particular constructions disclosed and shown in the drawings as examples, and also comprises the subject matter and such reasonable modifications or equivalents as are encompassed within the scope of the appended claims.

What is claimed is:

1. A container, comprising:

a container body defining at least side walls and a bottom, and having frame elements at least partly forming first and second door openings disposed at opposite ends of the container body, the first door opening having a lateral vertical axis on a first hinge side and an opposite latch side, and the second door opening having a top horizontal axis on a hinge side and a bottom latch side;

a first container closure including a door panel sized to fit the first door opening, the first door panel being hinged to the frame elements at the first hinge side and being movable around the lateral vertical axis so as to occupy the first door opening and to clear the first door opening;

a second container closure including a door panel sized to fit the second door opening, the second door panel being hinged to the frame elements at the top hinge side and being movable to occupy the second door opening;

a first closing mechanism for holding together the first door panel and the frame elements, the first closing mechanism being disposed along at least part of a side edge of the first door opening; and a second closing mechanism for holding together the second door panel and the frame elements, the second closing mechanism being disposed along at least part of a bottom edge of the second door opening, wherein at least one of said first and second closing mechanism is movable toward an associated one of the door panels when closed;

wherein the frame elements of the first door opening form a first lip portion disposed along a bottom edge of the first door opening and a second lip portion disposed along a top edge of the first door opening, the first lip portion extending upwardly from the bottom portion of the container body so as to define with the bottom portion a liquid containment sump;

wherein the frame elements of the first door opening including the first and second lip portions are configured to form a receiving opening that engages with an output end of a compaction apparatus to allow a slug of compacted material being pushed into an interior space of the container body via the receiving opening to pass over the first lip portion; and, wherein the compacted material can be dumped through the second door opening by releasing the second container closure and tilting the container.

2. The container of claim 1, further comprising at least one compressible sealing gasket disposed between at least one of the first and second door panel and the respective said frame elements therefor, wherein the at least one compressible sealing gasket is compressed between the respective first and second door panels and frame elements under an operative sealing pressure when the respective container closures are sealed with the respective said door panel occupying a closing position relative to said frame elements therefor.

3. The container of claim 1, wherein a horizontal projection of said second lip portion within said interior space defines a void space that is substantially empty subsequent to receipt of said slug of compacted material within said interior space.

4. The container of claim 1, further comprising a reinforcing chassis comprising:

first and second longitudinal support members for supporting the container thereon;

a vertical support plate mounted adjacent to a first end of the first and second longitudinal support members, the vertical support plate having a height and a width;

a horizontal support member mounted to the first end of the first and second longitudinal support members, the horizontal support member being connected to the vertical support plate to provide horizontal support over a substantial portion of the height of the vertical support plate; and first and second lateral support members, the first lateral support member connected to the first ends of the first and second longitudinal support members, the second lateral support member connected to the second ends of the first and second longitudinal support members, the first and second lateral support members each having a pair of vertically oriented projections disposed at lateral distal ends thereof, the vertically oriented projections being sized and shaped to be received within recesses of corner fittings of the container to center the container on the reinforcing chassis;

wherein when the container is supported on the first and second longitudinal support members with the vertically oriented projections received within the corner fittings, the vertical support plate abuts an end of the container, so that the vertical support plate and the horizontal support member provide horizontal support to the end of the container against loads applied to the end of the container from inside the container.

5. The container of claim 1, wherein the container is an intermodal configuration of a standard size and the liquid containment sump has a volume of about 600 gallons of liquid.

6. The container of claim 1, wherein the second container closure comprises a gasket and a structure for clamping the door panel of the second door opening against the gasket and thereby sealing the second door opening.

7. The container of claim 1, further comprising a supplemental locking mechanism bearing inwardly against the second container closure.

8. The container of claim 1, wherein the closing mechanism comprising a spring catch for holding the first door panel to one of the frame elements remote from the first hinge side, the spring catch engaging said one of the frame elements prior to the first door panel reaching the closing position.

9. The container of claim 8, wherein the spring catch is biased to engage said one of the frame elements and is positioned to hold the first door panel in an intermediate state after the first door panel is momentarily moved toward the closing position beyond the intermediate state, whereby slamming the door results in engagement of the spring catch to said one of the frame elements.

10. The container of claim 9, further comprising a door clamping mechanism operable to advance the door panel from the intermediate position to the closing position.

11. The container of claim 1, further comprising a top opening in the container for allowing material to be loaded into the interior space of the container, wherein the top opening encompasses a substantial portion of an upper wall of the container.

12. The container of claim 11, further comprising a lid sized to cover the top opening, the lid having a container engaging recess or projection disposed at an end of said lid, the container engaging recess configured to cooperate with a correspondingly shaped projection or recess disposed on said container to attach the lid to the container.

13. The container of claim 12, further comprising a plurality of lifting recesses disposed in a bottom portion of the container, said lifting recesses being oriented substantially perpendicular to a longitudinal axis of said container, wherein said lifting recesses are configured to receive respective forks of a fork lift.

14. The container of claim 1, wherein the first door is connected to the first door opening via a first hinge disposed along said hinge side and the second door is connected to the second door opening via a second hinge disposed along said top hinge side, and wherein the first hinge has a hinge axis oriented vertically and the second hinge has a hinge axis oriented horizontally.

15. The container of claim 14, wherein the first closing mechanism comprises at least two clamping tabs mounted on the first hinge side, the clamping tabs being movably mounted to apply pressure against a front surface of said first door panel.

16. The container of claim 15, wherein the clamping tabs are mounted on a lock shaft that is rotatable to press the clamping tabs into contact with the front surface of the first door panel.

17. The container of claim 14, wherein the second closing mechanism comprises at least two clamping tabs mounted on a sill of the second door opening, the clamping tabs being movably mounted to apply pressure against a front surface of said second door panel.

18. The container of claim 17, wherein the clamping tabs are mounted on a lock shaft that is rotatable to press the clamping tabs into contact with the front surface of said second door panel.

* * * * *